US009948025B2

(12) United States Patent
Hashimoto et al.

(10) Patent No.: US 9,948,025 B2
(45) Date of Patent: Apr. 17, 2018

(54) CONNECTOR

(71) Applicant: Sumitomo Wiring Systems, Ltd., Yokkaichi, Mie (JP)

(72) Inventors: Youjirou Hashimoto, Mie (JP); Kazuo Nakai, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/408,640

(22) Filed: Jan. 18, 2017

(65) Prior Publication Data

US 2017/0222356 A1 Aug. 3, 2017

(30) Foreign Application Priority Data

Jan. 29, 2016 (JP) ..... 2016-016072

(51) Int. Cl.

| | |
|---|---|
| ***H01R 4/38*** | (2006.01) |
| ***H01R 13/533*** | (2006.01) |
| ***H01R 13/14*** | (2006.01) |
| ***H01R 13/426*** | (2006.01) |
| ***H01R 13/432*** | (2006.01) |
| ***H01R 13/52*** | (2006.01) |
| ***H01R 13/629*** | (2006.01) |
| ***H01R 13/506*** | (2006.01) |
| *H01R 13/422* | (2006.01) |
| *H01R 13/436* | (2006.01) |
| *H01R 13/627* | (2006.01) |

(52) U.S. Cl.

CPC ..... *H01R 13/533* (2013.01); *H01R 13/14* (2013.01); *H01R 13/426* (2013.01); *H01R 13/432* (2013.01); *H01R 13/506* (2013.01); *H01R 13/5208* (2013.01); *H01R 13/62955* (2013.01); *H01R 13/4223* (2013.01); *H01R 13/4364* (2013.01); *H01R 13/5205* (2013.01); *H01R 13/6272* (2013.01)

(58) Field of Classification Search

CPC ..... H01R 13/62955; H01R 13/5208; H01R 13/432; H01R 13/426; H01R 13/14; H01R 13/533

USPC ..... 439/275, 357, 358, 457, 456, 458, 449, 439/470, 279, 460, 353, 354, 587, 274, 439/589

See application file for complete search history.

(56) References Cited

U.S. PATENT DOCUMENTS 5,399,045 A * 3/1995 Yoneda ..... H01R 13/5219 403/321

5,520,548 A * 5/1996 Hotea ..... H01R 13/533 439/271

(Continued)

FOREIGN PATENT DOCUMENTS

JP 2015-18671 1/2015

*Primary Examiner* — Abdullah Riyami
*Assistant Examiner* — Nelson R Burgos-Guntin
(74) *Attorney, Agent, or Firm* — Gerald E. Hespos; Michael J. Porco; Matthew T. Hespos

(57) ABSTRACT

A connector (F) includes an inner housing (11). Terminal fittings (72) are fixed to front end parts of wires (71) and are inserted into the inner housing (11) from behind. An outer housing (37) is held out of contact with the terminal fittings (72) and is mounted relatively displaceably with respect to the inner housing (11). Vibration damping rings (64) are fit externally on the wires (71) in a state out of contact with the inner housing (11), and are held resiliently in contact with the outer housing (37).

15 Claims, 21 Drawing Sheets

(56) References Cited

U.S. PATENT DOCUMENTS 5,527,188 A * 6/1996 Ohtaka ..... H01R 13/5205 439/275
5,607,318 A * 3/1997 Wakata ..... H01R 13/4223 439/274
5,611,706 A * 3/1997 Makita ..... H01R 13/5205 439/275
5,660,566 A * 8/1997 Ohsumi ..... H01R 13/5205 439/275
5,769,650 A * 6/1998 Aoyama ..... H01R 13/4365 439/189
5,830,002 A * 11/1998 Ito ..... H01R 13/6272 439/358
5,897,396 A * 4/1999 Maejima ..... H01R 13/5208 439/275
5,921,805 A * 7/1999 Tabata ..... H01R 13/5804 439/457
5,931,699 A * 8/1999 Saito ..... H01R 13/5208 439/275
6,033,261 A * 3/2000 Wakata ..... H01R 13/5205 439/587
6,109,953 A * 8/2000 Hashigaya ..... H01R 33/09 439/457
6,244,898 B1 * 6/2001 Suzuki ..... H01R 13/5205 439/274
6,398,571 B1 * 6/2002 Nishide ..... H01R 13/5205 439/275
6,419,515 B1 * 7/2002 Okayasu ..... H01R 13/627 439/352
6,579,113 B2 * 6/2003 Kodama ..... H01R 13/6272 439/358
7,214,080 B2 * 5/2007 Ichio ..... H01R 13/6315 439/246
7,338,320 B2 * 3/2008 Kobayashi ..... F16J 13/02 439/275
7,488,196 B2 * 2/2009 Kocher ..... H01R 4/26 439/393
7,503,791 B2 * 3/2009 Fukaya ..... H01R 13/5208 439/275
7,503,793 B2 * 3/2009 Morello ..... H01R 13/6272 439/352
7,575,464 B2 * 8/2009 Kobayashi ..... H01R 13/6272 439/358
8,905,784 B2 * 12/2014 Perotto ..... B29C 45/14639 439/587
9,071,021 B2 * 6/2015 Hiramatsu ..... H01R 13/6277
9,257,773 B2 * 2/2016 Kitajima ..... H01R 13/4362
9,385,516 B2 * 7/2016 Tanaka ..... H02G 3/22
9,543,687 B2 * 1/2017 Horiuchi ..... H01R 13/502
9,577,382 B2 * 2/2017 Kida ..... H01R 13/641
9,666,989 B2 * 5/2017 Horiuchi ..... H01R 13/64
2002/0155756 A1 * 10/2002 Yoshioka ..... H01R 13/748 439/607.01
2004/0166717 A1 * 8/2004 Muro ..... H01R 13/6272 439/358
2005/0118850 A1 * 6/2005 Ito ..... H01R 13/5208 439/275
2005/0176298 A1 * 8/2005 Flowers ..... H01R 13/4365 439/595
2007/0059970 A1 * 3/2007 Ichio ..... H01R 13/6315 439/382
2009/0111313 A1 * 4/2009 Nagamine ..... H01R 13/6275 439/358
2009/0111314 A1 * 4/2009 Nagamine ..... H01R 13/6277 439/358
2009/0247000 A1 * 10/2009 Shuey ..... H01R 13/4365 439/358
2011/0045696 A1 * 2/2011 Nakamura ..... H01R 13/516 439/587
2015/0111409 A1 * 4/2015 Miyakawa ..... H01R 13/6273 439/357
2015/0333430 A1 * 11/2015 Hashimoto ..... H01R 13/422 439/752

* cited by examiner

CONNECTOR

BACKGROUND

1. Field of the Invention

The invention relates to a connector.

2. Related Art

Japanese Unexamined Patent Publication No. 2015-018617 discloses a connector in which a terminal-side housing carrier for accommodating and holding terminal fittings and a wire-side housing carrier for accommodating wires are coupled via a resilient portion. In this connector, if the wire vibrates, the terminal-side housing carrier and the wire-side housing carrier are displaced relatively while resiliently deforming the resilient portion and the vibration of the wire can be attenuated by this resilient deformation of the resilient portion.

In the above-described connector, the wires are directly in contact with the resilient portion and the resilient portion is directly in contact with the terminal-side housing carrier. Thus, the transfer of vibration of the wire to the terminal fitting via the resilient portion and the terminal-side housing carrier is unavoidable and a sufficient effect cannot be expected in suppressing the transfer of vibration to the terminal fitting.

The invention was completed based on the above situation and aims to improve a function of suppressing the transfer of vibration from a wire to a terminal fitting.

SUMMARY

The invention relates to a connector with an inner housing, a terminal fitting fixed to a front end part of a wire and inserted into the inner housing from behind, an outer housing held out of contact with the terminal fitting and mounted relatively displaceably with respect to the inner housing, and a vibration damping ring externally fit on the wire in a state out of contact with the inner housing, and resiliently held in contact with the outer housing.

The inner housing and the outer housing may be positioned via at least one resilient positioning member. Thus, vibration energy transferred from the wire to the outer housing is attenuated by the resilient positioning member, thereby suppressing the transfer of vibration to the inner housing.

The inner housing may be connectable to a mating housing that has a mating terminal. The inner housing may be formed with at least one displacement restricting portion configured to restrict a relative displacement with respect to the mating housing. According to this configuration, the inner housing is connected to the mating housing with a relative displacement restricted and relative displacements of the terminal fitting and the mating terminal are restricted. Thus, fine sliding abrasion between the terminal fitting and the mating terminal can be suppressed.

The inner housing may include a housing body configured to accommodate the terminal fitting. A front retainer may be mounted in a front end part of the housing body and may be configured to restrict the escape of the terminal fitting from the housing body. The displacement restricting portion may project on an outer peripheral surface of the front retainer and may be capable of being held in close contact with an inner periphery of a receptacle of the mating housing while being plastically deformed. According to this configuration, the front retainer is formed with the displacement restricting portion. Thus, the shape of the housing body can be simplified.

The connector may further include at least one locking lance configured to retain the terminal fitting inserted into the inner housing from behind. A restricting projection may be formed on a front wall of the front retainer and may be configured to restrict a movement of the terminal fitting by coming into contact with a front surface of the terminal fitting. Thus, the terminal fitting is sandwiched between the locking lance and the restricting projection substantially in a front-back direction. According to this configuration, a movement of the terminal fitting in the front-back direction can be restricted reliably, utilizing the front retainer separate from the housing body. In this way, fine sliding abrasion between the terminal fitting and the mating terminal can be reliably prevented.

The inner housing may be connectable to a mating housing including at least one mating terminal, and the inner housing may be formed with a lock arm configured to hold a connected state to the mating housing by being locked to the mating housing. According to this configuration, the inner housing and the mating housing are locked in the connected state by the lock arm. Thus, fine sliding abrasion between the terminal fitting and the mating terminal can be suppressed.

A resilient member (particularly comprising or in the form of a rubber plug) may be configured to seal a clearance between the wire and the inner housing and may be fit externally on the wire. The vibration damping ring may be formed integrally or unitarily to the resilient member (particularly the rubber plug). According to this configuration, the number of components can be reduced as compared to the case where the vibration damping ring and the resilient member (particularly the rubber plug) are separate components.

The resilient member (particularly the rubber plug) may include at least one sealing portion to be held in close contact with an inner periphery of the inner housing in a fluid-tight (particularly liquid-tight) manner, and the vibration damping ring may be arranged behind the sealing portion and/or have a larger outer diameter than the sealing portion. According to this configuration, the vibration damping ring with a large outer diameter is present behind the sealing portion. Thus, even if high-pressure washing water is sprayed from behind the outer housing, the high-pressure washing water is not directly sprayed to the sealing portion.

Since vibration energy of the wire is transferred to the outer housing via the vibration damping ring and attenuated by an inertial force of the outer housing, the transfer of vibration to the terminal fitting is suppressed. No vibration transfer path by direct contact between the vibration damping ring and the inner housing is present between the vibration damping ring and the terminal fitting, a function of suppressing the transfer of vibration from the wire to the terminal fitting is excellent.

These and other features of the invention will become more apparent upon reading the following detailed description and accompanying drawings. It should be understood that even though embodiments are described separately, single features thereof may be combined to additional embodiments.

DETAILED DESCRIPTION

Figure 8:
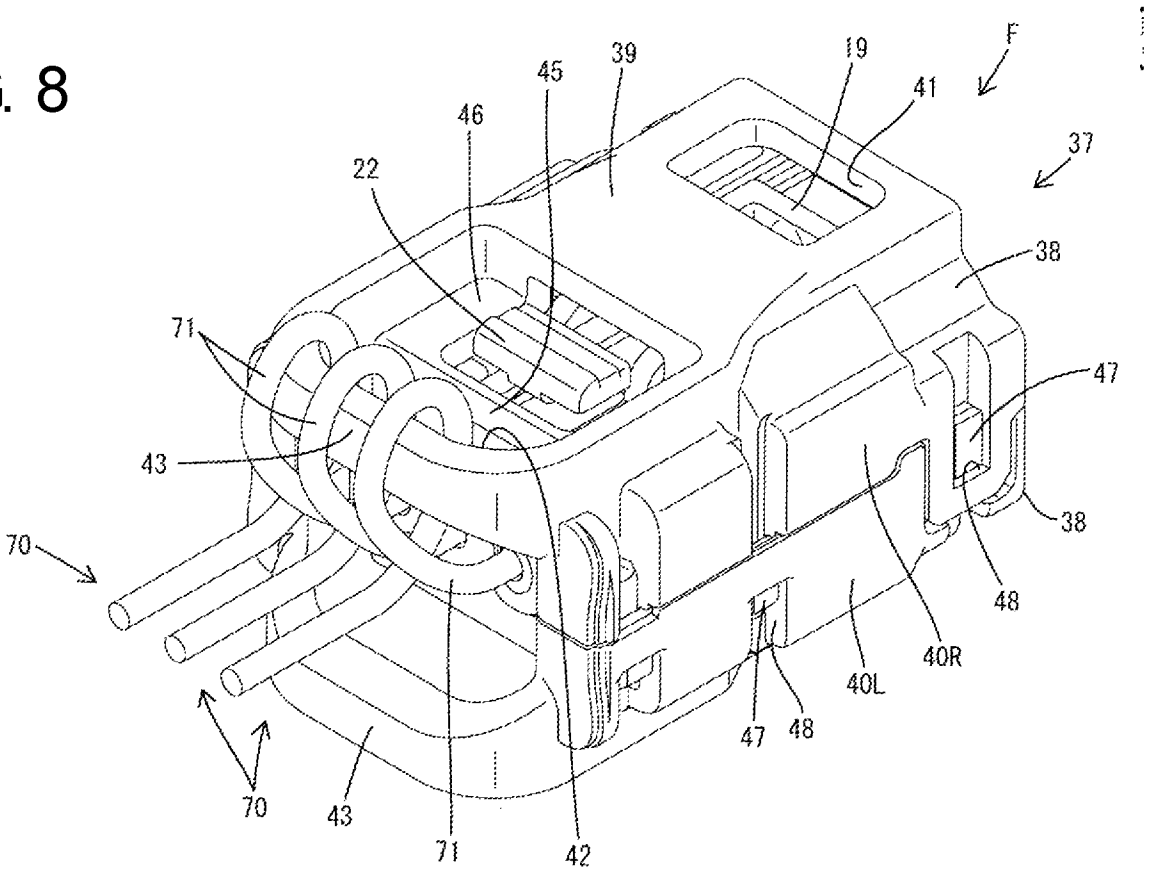
FIG. 8 is a perspective view of the female housing viewed from behind.
Figure 16:
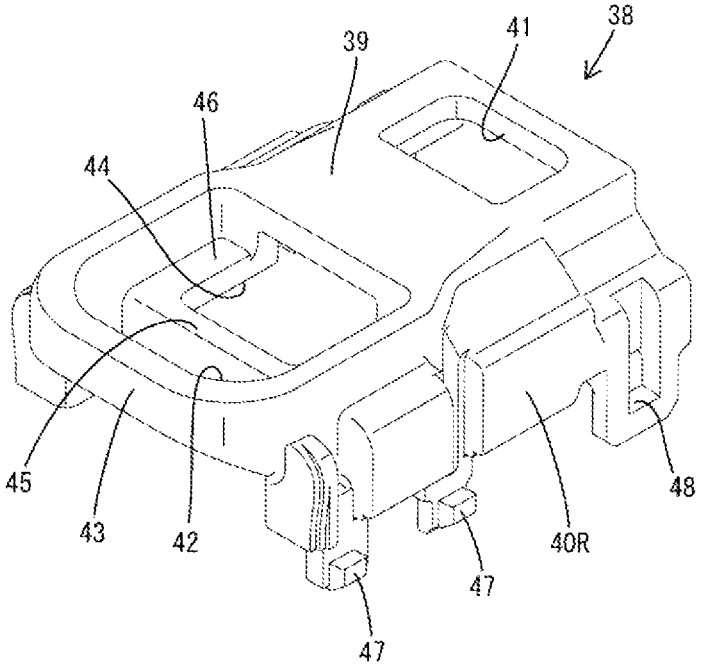
FIG. 16 is a perspective view showing an upper half member constituting the outer housing viewed obliquely from an upper rear side.
Figure 17:
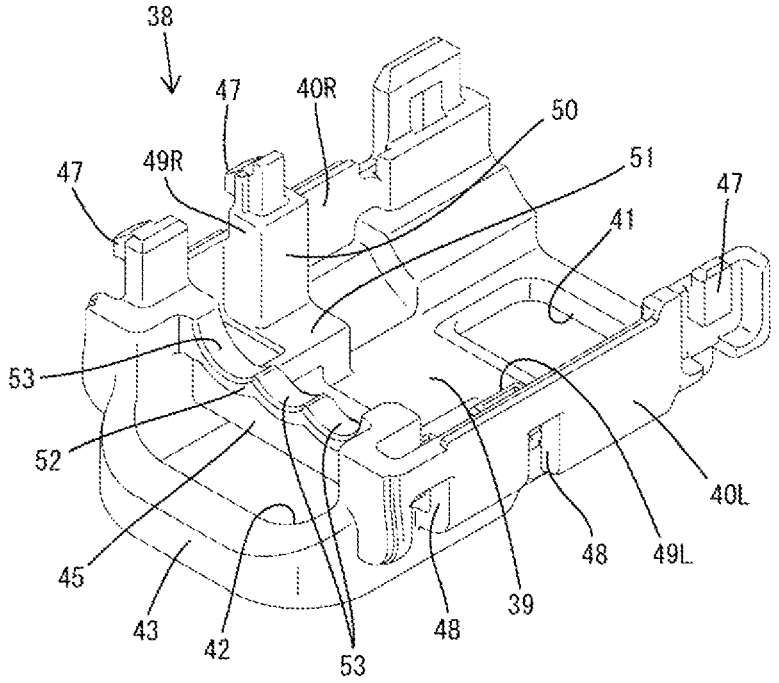
FIG. 17 is a perspective view showing a lower half member constituting the outer housing viewed obliquely from an upper rear side.

One specific embodiment of the invention is described with reference to FIGS. 1 to 21. Note that, in the following description, a left side in FIGS. 7, 9 to 12, 15 and 19, an oblique left lower side in FIGS. 1 to 4 and 21 and an oblique right upper side in FIGS. 8, 16 and 17 are defined as a front side concerning a front-back direction. Concerning a vertical direction, upper and lower sides shown in FIGS. 1 to 6, 8 to 10, 13 to 18, 20 and 21 are defined as upper and lower sides. A connector of this embodiment includes a male connector M and a female connector F connectable to and separable from each other.

<Male Connector M>

Figure 9:
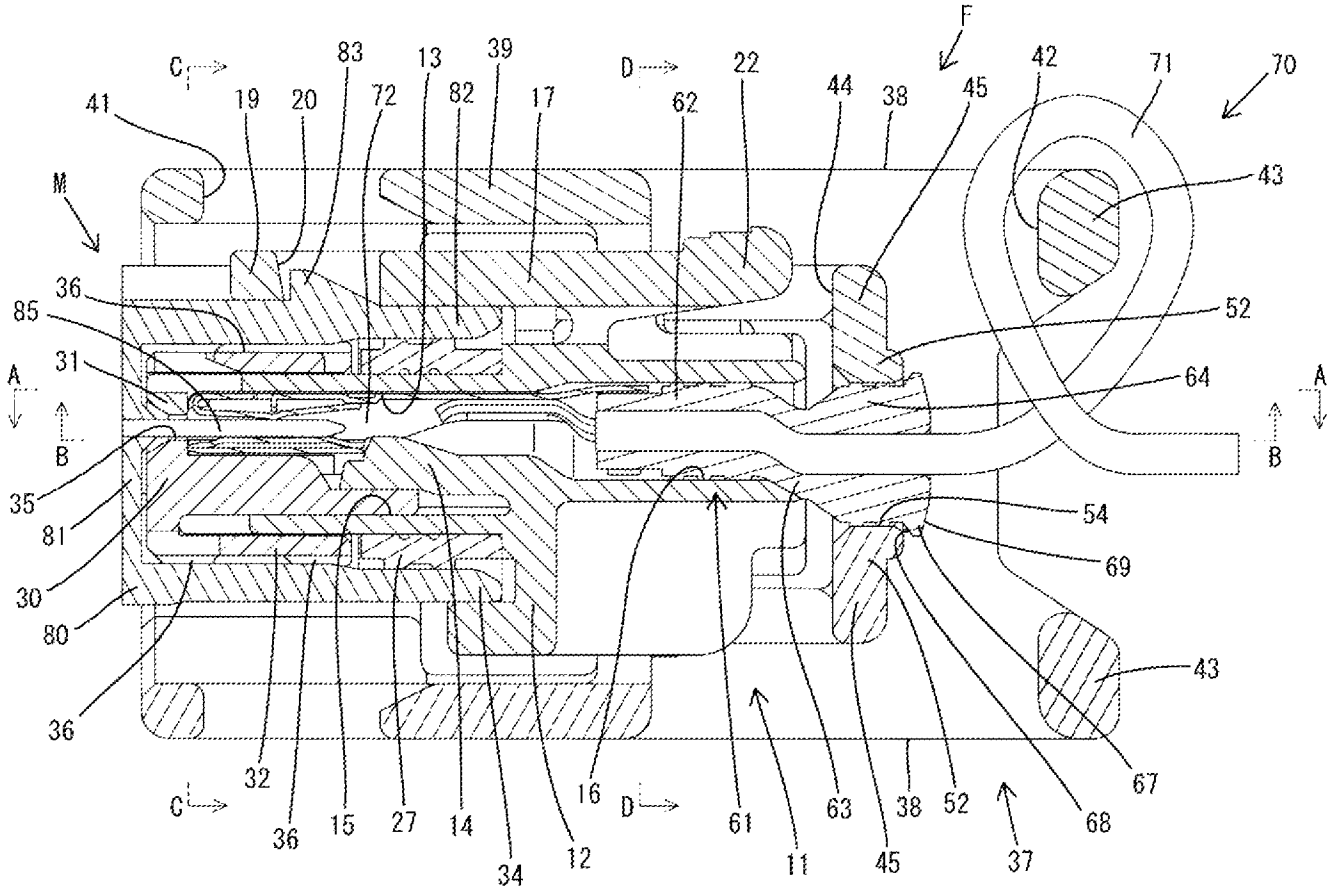
FIG. 9 is a side view in section showing a state where the female housing and a male housing are connected.
Figure 10:
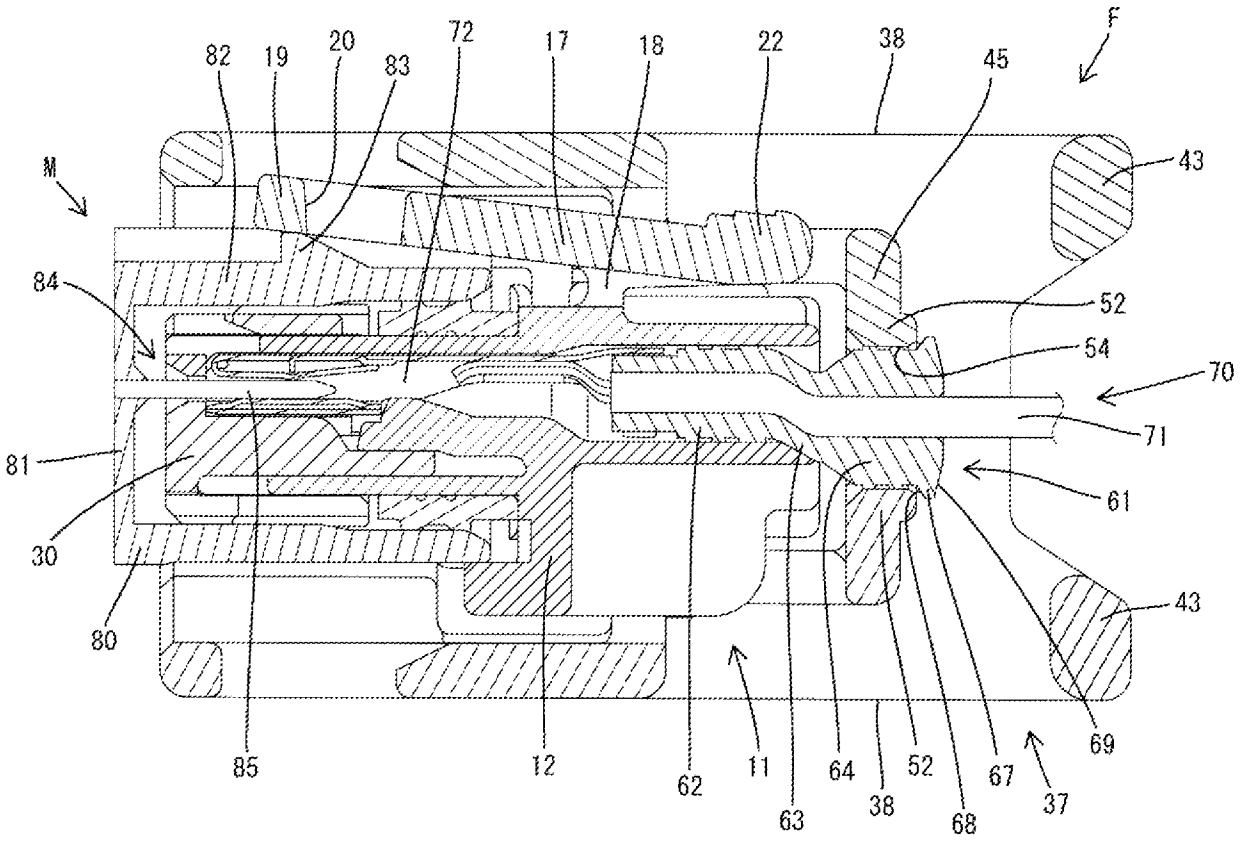
FIG. 10 is a side view in section showing the process of connecting the female housing and the male housing.

As shown in FIGS. 9 and 10, the male connector M has a male housing 80 made e.g. of synthetic resin. The male housing 80 includes a terminal holding portion 81 and a receptacle 82 projecting in the same direction as a connecting direction to the female connector F (right in FIGS. 9 and 10) from the terminal holding portion 81. A lock projection 83 is formed on the upper surface (outer surface) of an upper wall the receptacle 82. Three male terminal fittings 84 are mounted side by side in a lateral direction in the male housing 80. Each male terminal fitting 84 includes a tab 85 projecting into the receptacle 82 from the terminal holding portion 81 as a later-described means to be connected to a female terminal fitting 72.

<Female Connector F>

The female connector F is composed of front end parts of three conductive paths 70 and a female housing 10. Each conductive path 70 includes a wire 71 and the female terminal fitting 72 electrically connected (e.g. crimped) to a wire 71 to a front end part of the wire 71 and a rubber plug 61 externally fit to the front end part of the wire 71 and connected to a rear end part of the female terminal fitting 72 by crimping. The terminal fitting and the rubber plug 61 are inserted into the female housing 10 from behind. The female housing 10 includes an inner housing 11 made e.g. of synthetic resin, a seal ring 27 made of resilient material such as rubber, an outer housing 37 made of synthetic resin and a pair of left and right resilient positioning members 55 made of rubber.

<Inner Housing 11>

Figure 11:
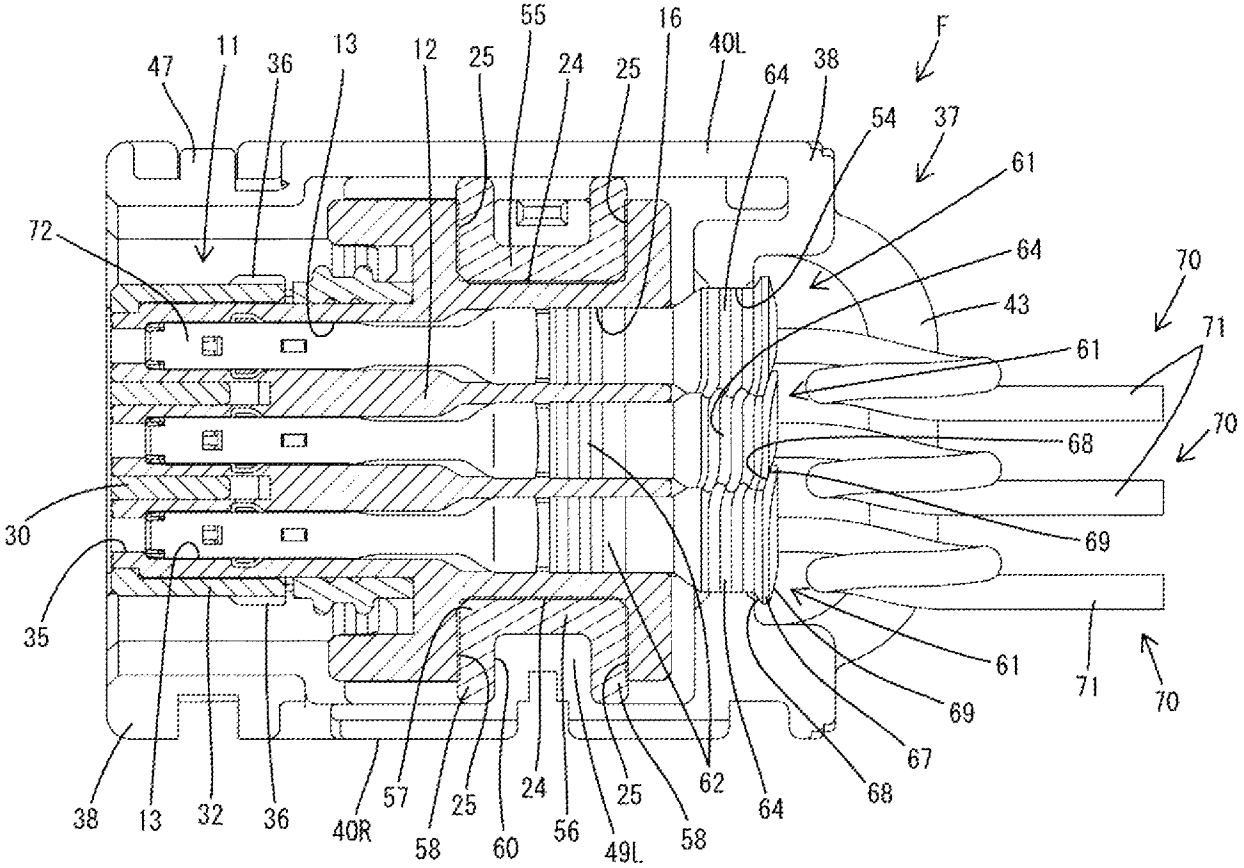
FIG. 11 is a section along A-A of FIG. 9.
Figure 12:
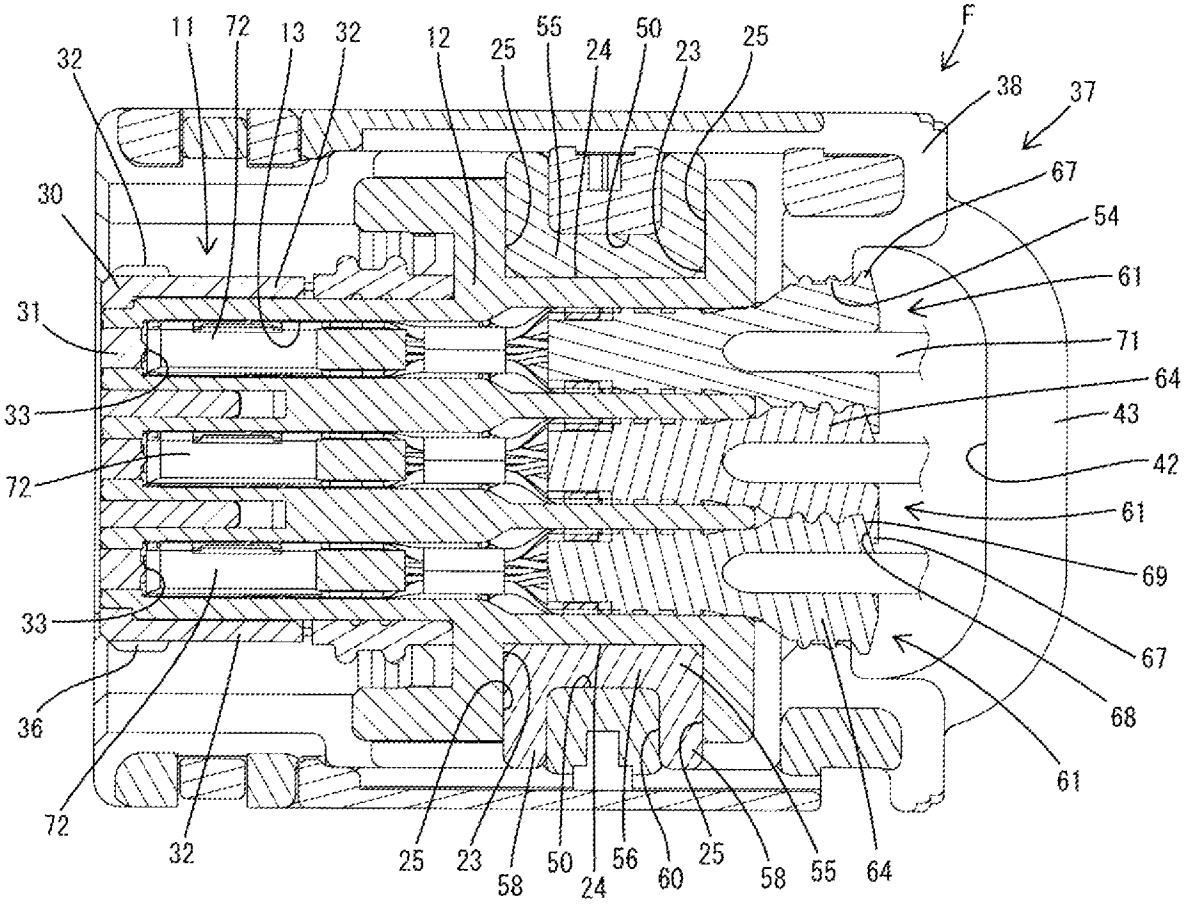
FIG. 12 is a section along B-B of FIG. 9.
Figure 13:
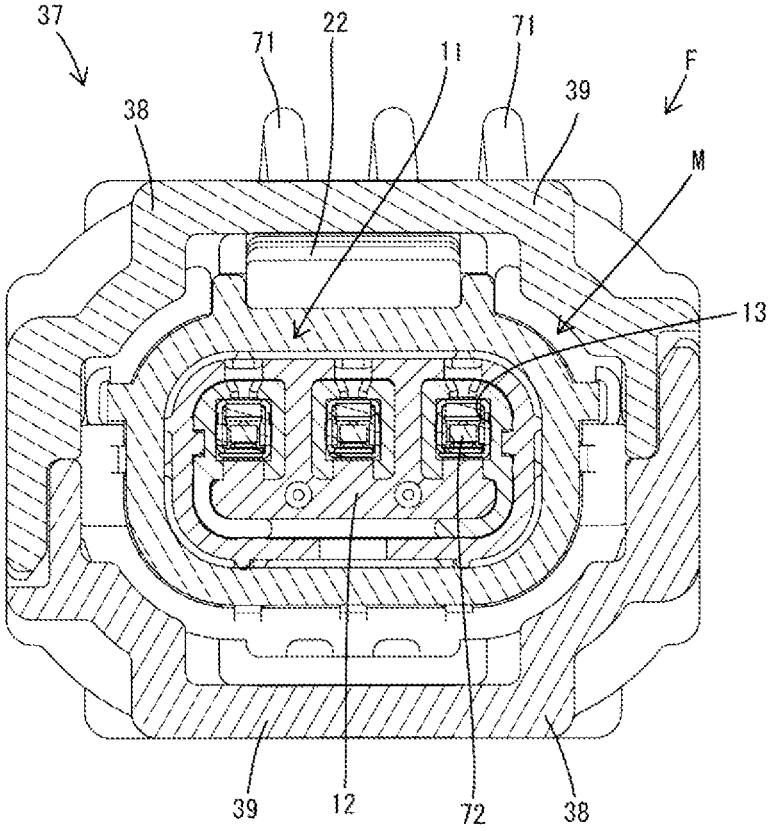
FIG. 13 is a section along C-C of FIG. 9.

The inner housing 11 is formed by assembling a bilaterally symmetrical housing body 12 made of synthetic resin and a bilaterally symmetrical front retainer 30 made of synthetic resin. As shown in FIG. 11 or 12, three terminal accommodating chambers 13 are formed side by side in the lateral direction in the housing body 12 and the female terminal fittings 72 can be inserted therein from behind. Locking lances 14 are cantilevered forward along the lower surfaces of the terminal accommodating chambers 13 and deflection spaces 15 for allowing the locking lances 14 to be resiliently deformed in a direction away from the terminal accommodating chambers 13 (down) are formed in the housing body 12. A rear end part of the inner periphery of the terminal accommodating chamber 13 defines a sealing surface 16 that will closely contact the rubber plug 61.

Figure 3:
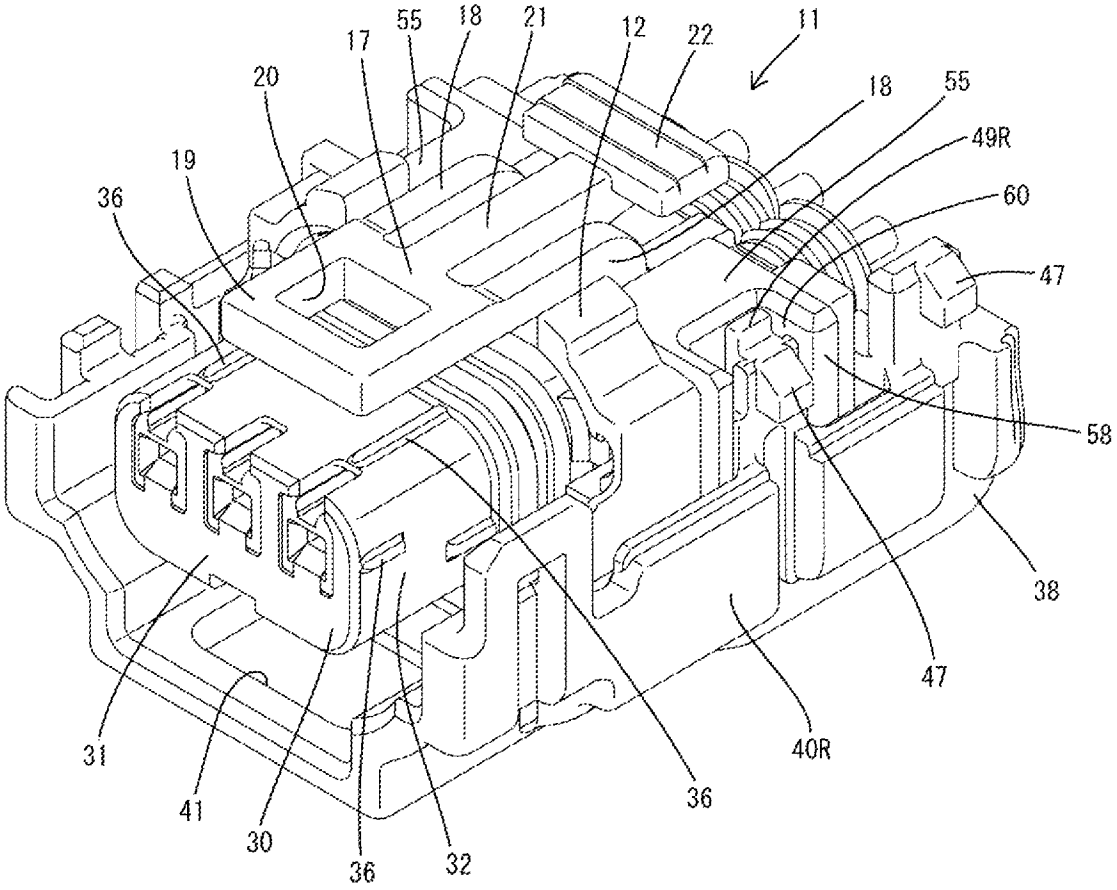
FIG. 3 is a perspective view showing a state where a half member of the outer housing is mounted to the lower surface of the inner housing.

As shown in FIG. 3, a lock arm 17 is formed on the upper surface of the housing body 12. The lock arm 17 includes left and right supports 18 extending forward from the upper surface of the housing body 12 and a lock 19 connected between front end parts of the supports 18. A lock hole 20 penetrates the lock 19 in the vertical direction (or a direction intersecting the connecting direction). The lock arm 17 includes an arm portion 21 extending back from the rear end edge of the lock 19 between the supports 18. A lock releasing portion 22 wider than the arm portion 21 is formed on a rear end part of the arm portion 21.

The lock arm 17 is resiliently deformable in a seesaw manner with rear ends of the supports 18 acting as fulcrums so that the lock 19 is displaced up and the lock releasing portion 22 is displaced down. This seesaw-like resilient deformation occurs in the process of connecting both male and female housings 80, 10 and when the two connectors M, F in a connected state are separated.

Figure 1:
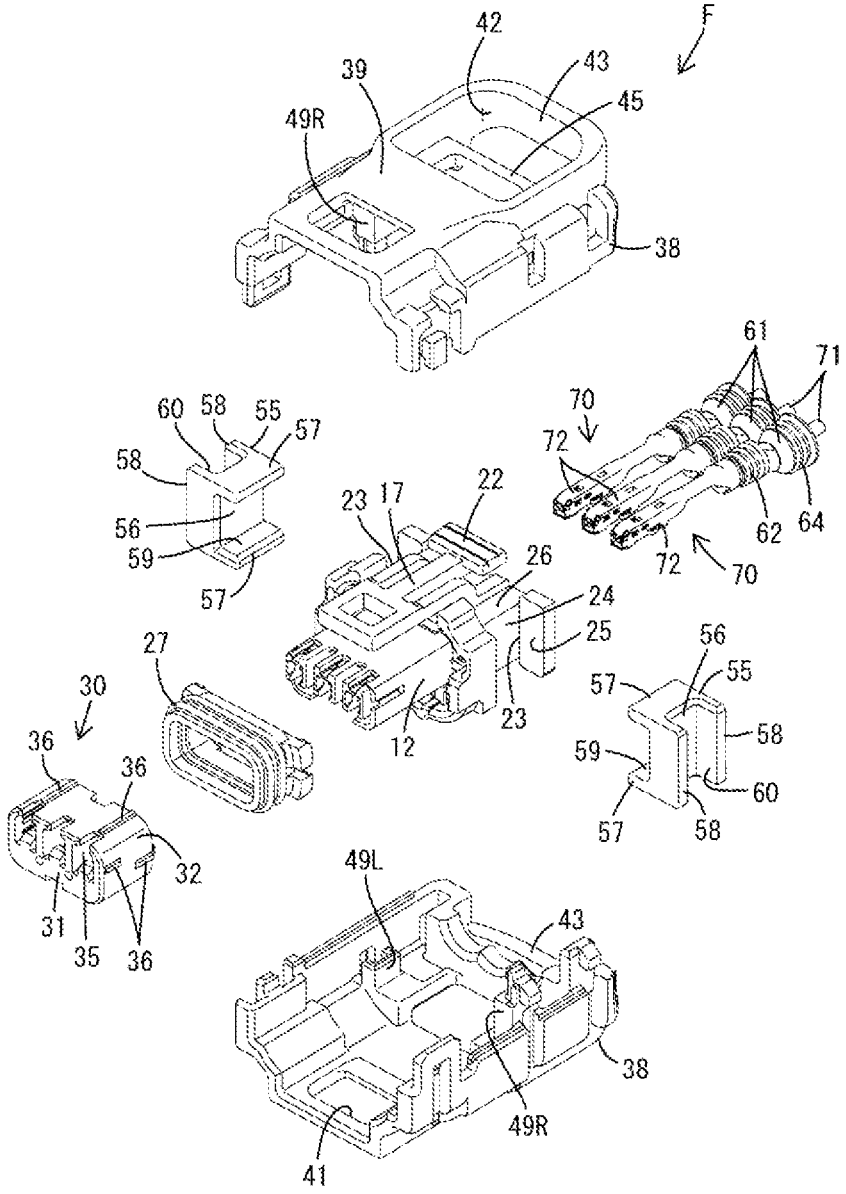
FIG. 1 is a perspective view showing an exploded state of a female connector (connector) of one embodiment.
Figure 15:
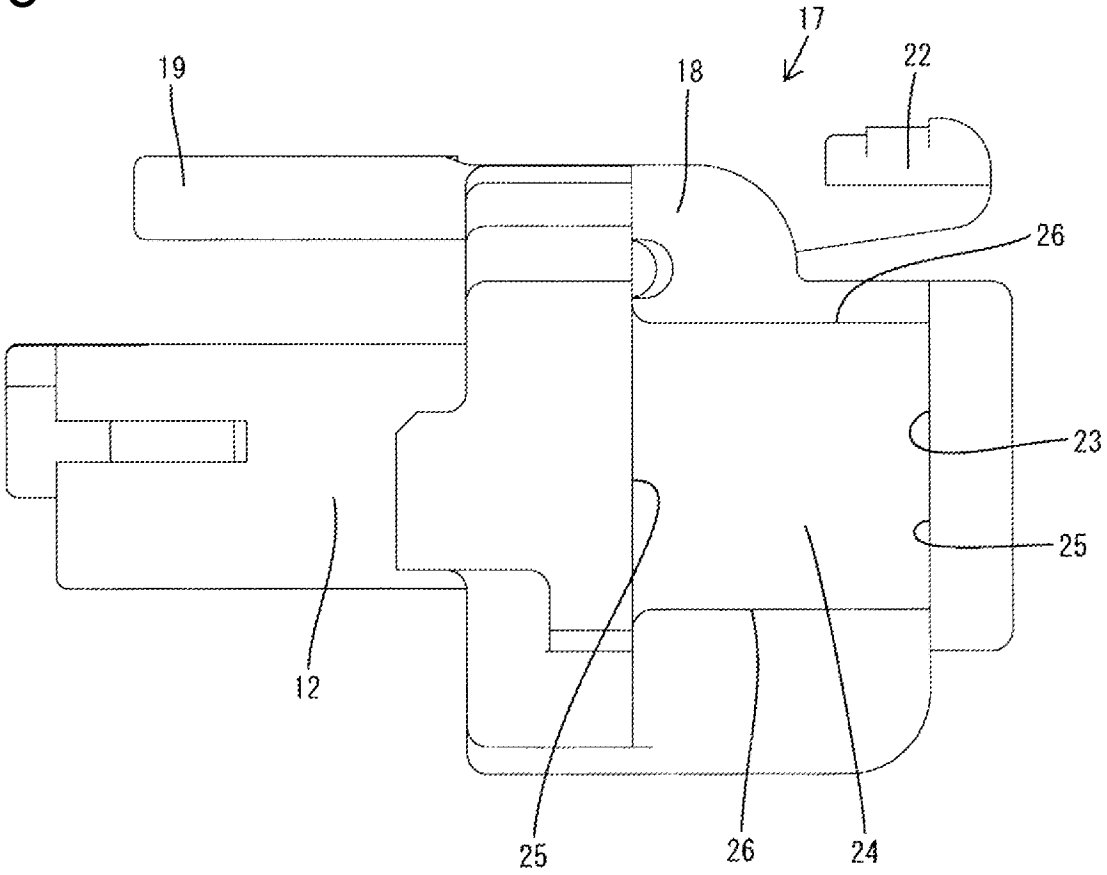
FIG. 15 is a side view of a housing body constituting an inner housing.

As shown in FIGS. 1, 12 and 15, two positioning recesses 23 are formed on both left and right side parts of the housing body 12 and open both down and up and laterally outward. Each positioning recess 23 has an outer contact surface 24 constituting an outer side surface of the housing body 12 and front and rear facing surfaces 25 substantially at a right angle to the outer contact surface 24. A horizontal area connected substantially at a right angle to the upper end edge of the outer contact surface 24 and a horizontal area connected substantially at a right angle to the lower end edge of the outer contact surface 24 define receiving surfaces 26. Further, as shown in FIG. 9, the seal ring 27 made of rubber is fit externally on the outer periphery of the housing body 12 adjacent to or in front of the positioning recesses 23.

As shown in FIGS. 1 and 12, the front retainer 30 includes a front wall 31, a tubular peripheral wall 32 projecting back from the outer peripheral edge of the front wall 31, three restricting projections 33 projecting back from the rear surface of the front wall 31 and deflection restricting portions 34 extending back from the rear surface of the front wall 31. The front wall 31 is formed with tab insertion openings 35 corresponding to the terminal accommodating chambers 13. Displacement restricting portions 36 are formed on the outer periphery of the peripheral wall 32. The displacement restricting portions 36 are rib-like projections arranged on both upper and lower surfaces and both left and right side surfaces of the outer periphery of the peripheral wall 32.

The front retainer 30 is mounted to fit the peripheral wall 32 externally to a front end part of the housing body 12. In a mounted state, the three restricting projections 33 are in contact with the front ends of the three female terminal fittings 72 from the front as shown in FIG. 12 so that the female terminal fittings 72 are sandwiched between the locking lances 14 and the restricting projections 33 in the front-back direction to have movements thereof in the front-back direction restricted. Further, the deflection restricting portions 34 are inserted into the deflection spaces 15 to restrict displacements of the locking lances 14 in a direction to be disengaged from the female terminal fittings 72. A rear end part of the peripheral wall 32 restricts an improper forward movement of the seal ring 27.

<Outer Housing 37>

Figure 4:
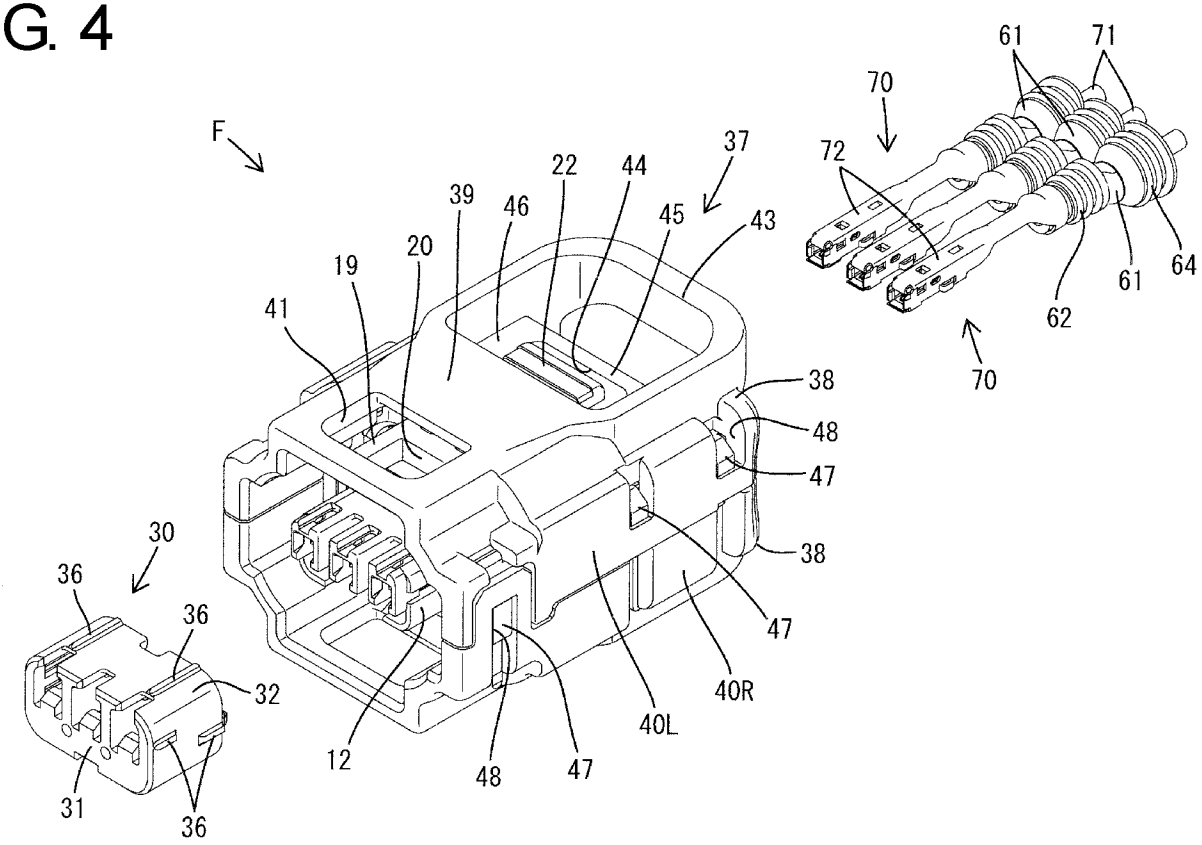
FIG. 4 is a perspective view showing a state where a front retainer, terminal fittings and rubber plugs are removed in the female housing.
Figure 5:
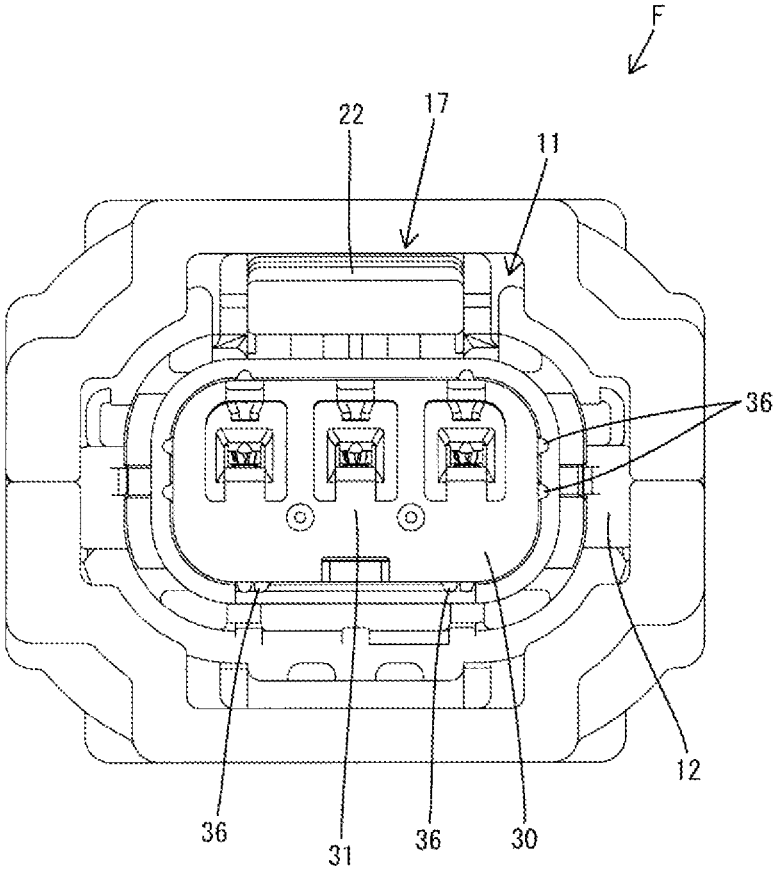
FIG. 5 is a front view of the female housing.
Figure 6:
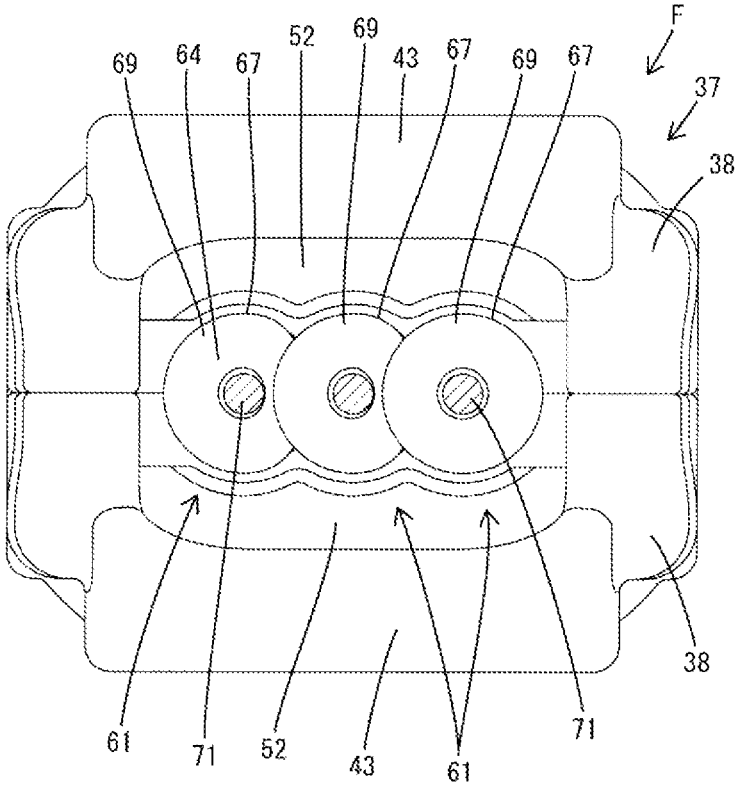
FIG. 6 is a rear view of the female housing.
Figure 7:
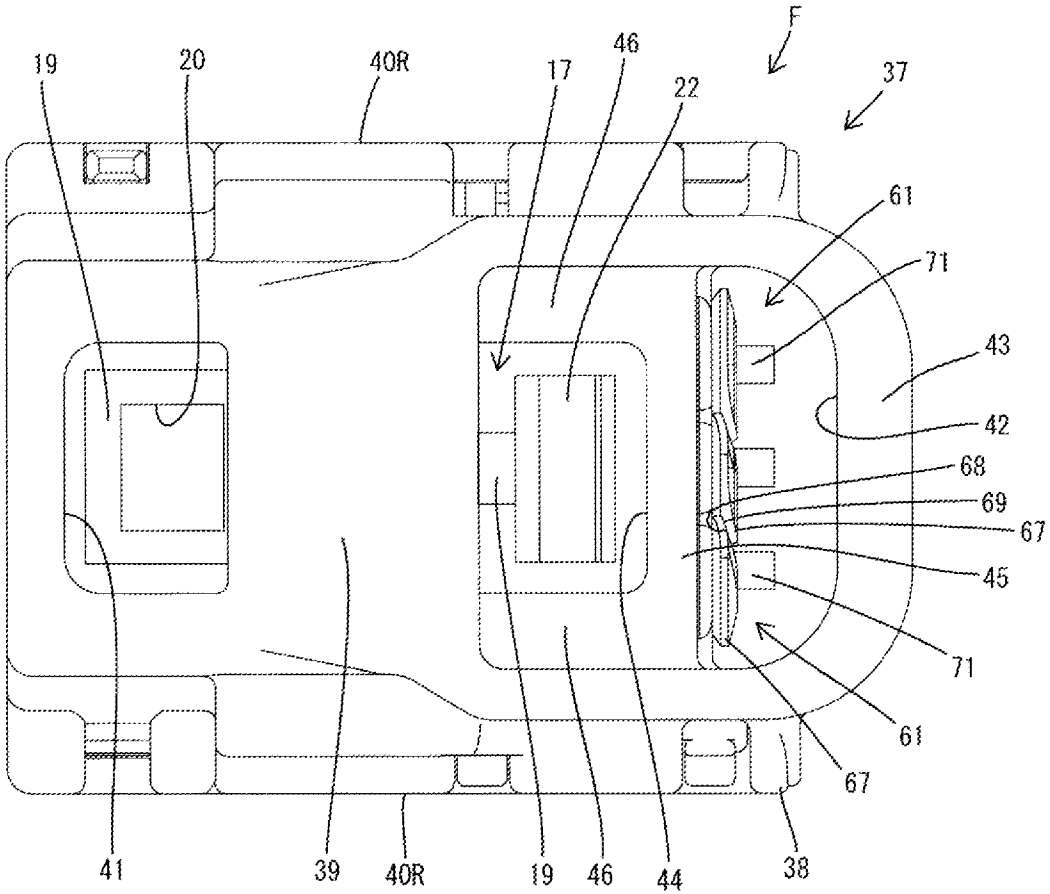
FIG. 7 is a plan view of the female housing.
Figure 18:
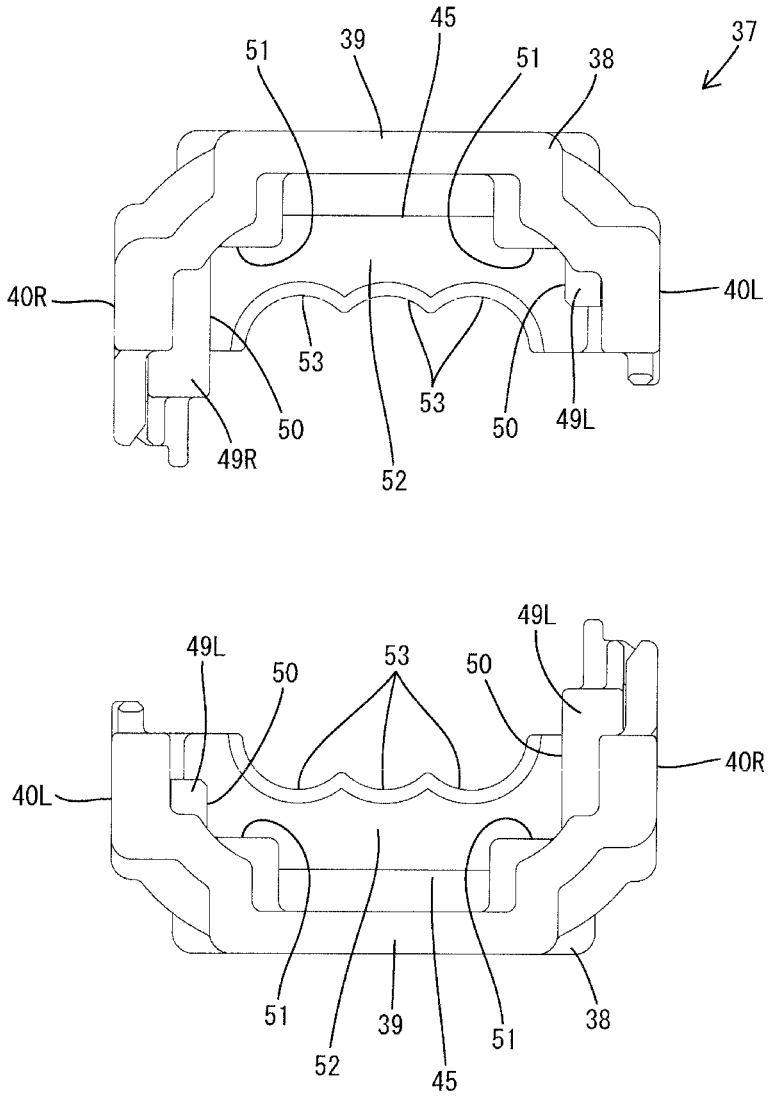
FIG. 18 is a front view showing a state where a pair of upper and lower half members constituting the outer housing are separated.

As shown in FIGS. 4 and 18, the outer housing 37 is composed of upper and lower half members 38. The half members 38 are identical components and constitute the outer housing 37 by being united in a positional relationship point symmetrical with respect to an axis extending in the front-back direction (not shown). Note that directions in the following description of the half members 38 are based on the upper half member 38 for the sake of convenience.

Figure 19:
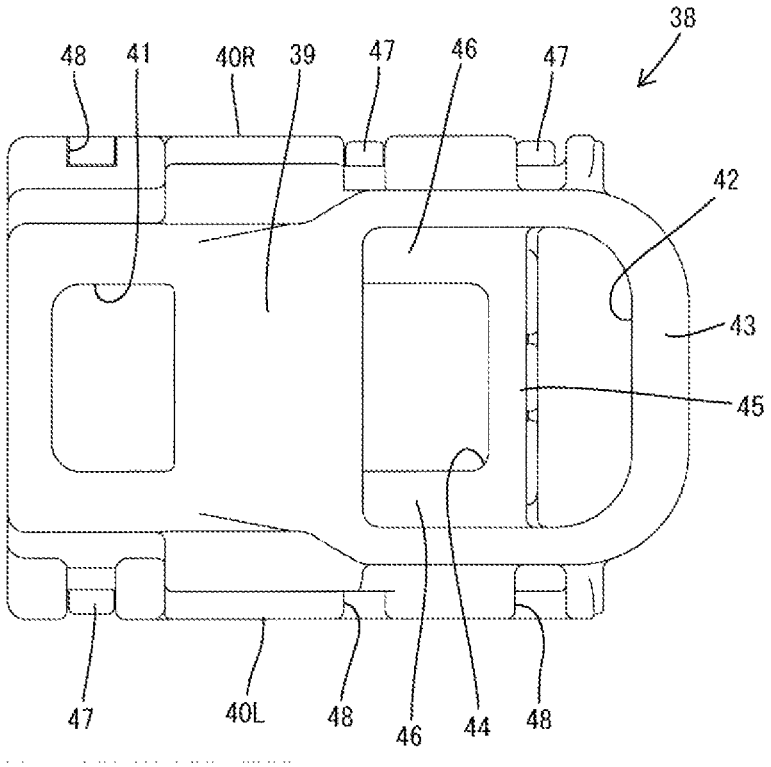
FIG. 19 is a plan view of the upper half member constituting the outer housing.
Figure 20:
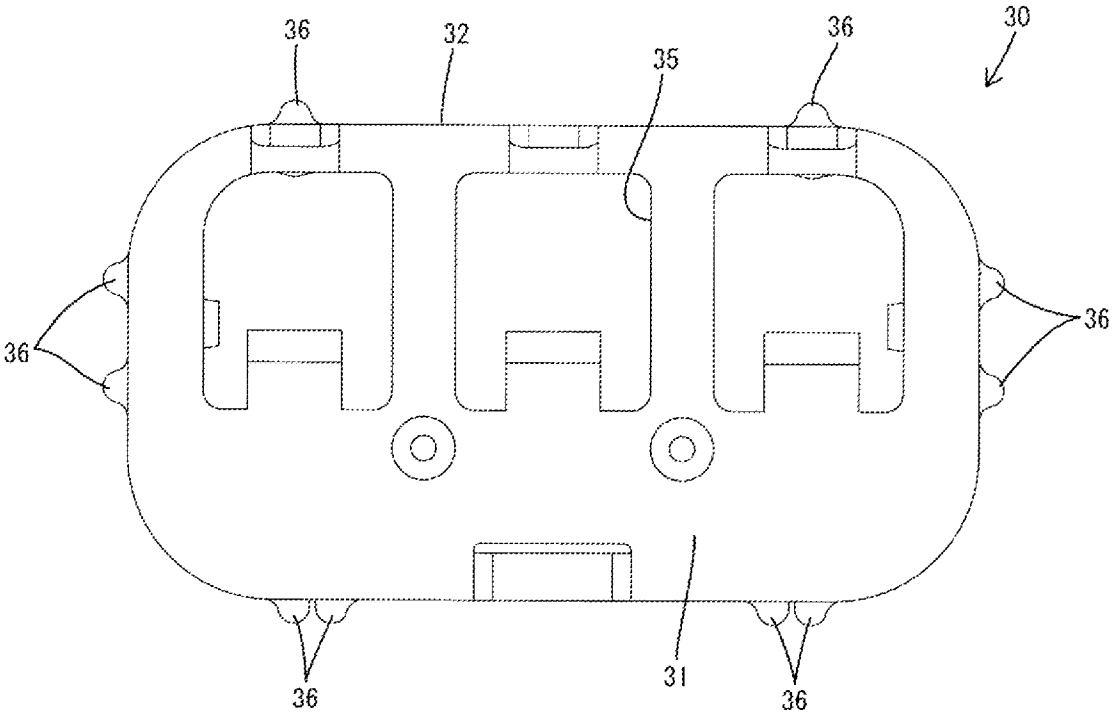
FIG. 20 is a front view of a front retainer.

As shown in FIGS. 16, 17 and 19, each half member 38 includes a bilaterally symmetrical outer wall 39 and two bilaterally symmetrical side walls 40L, 40R extending down from both left and right side edges of the outer wall 39. A substantially square interference avoiding hole 41 vertically penetrates through a front end part of the outer wall 39. A substantially square winding opening 42 vertically penetrates through a rear end part of the outer wall 39. By forming the winding opening 42, a rear end edge part of the outer wall 39 functions as a slack holding portion 43 that is long and narrow in the lateral direction.

An operation opening 44 vertically penetrates an area of the outer wall 39 before and adjacent to the winding opening 42. A boundary part of the outer wall 39 between the winding opening 42 and the operation opening 44 functions as a rear edge protecting portion 45 long and narrow in the lateral direction. Further, areas of the left and right side walls 40L, 40R extending along the opening edge of the operation opening 44 function as side edge protecting portions 46.

A locking projection 47 is formed on the outer surface of a front part of the left side wall 40L. Locking holes 48 penetrate from an inner surface to an outer surface in a substantially central part of the left side wall 40L in the front-back direction and a rear end part of the left side wall 40L. On the other hand, a locking hole 48 penetrates from an inner surface to an outer surface on the outer surface of a front part of the right side wall 40R. Locking projections 47 are formed respectively in a substantially central part of the right side wall 40R in the front-back direction and a rear end part of the right side wall 40R.

Figure 2:
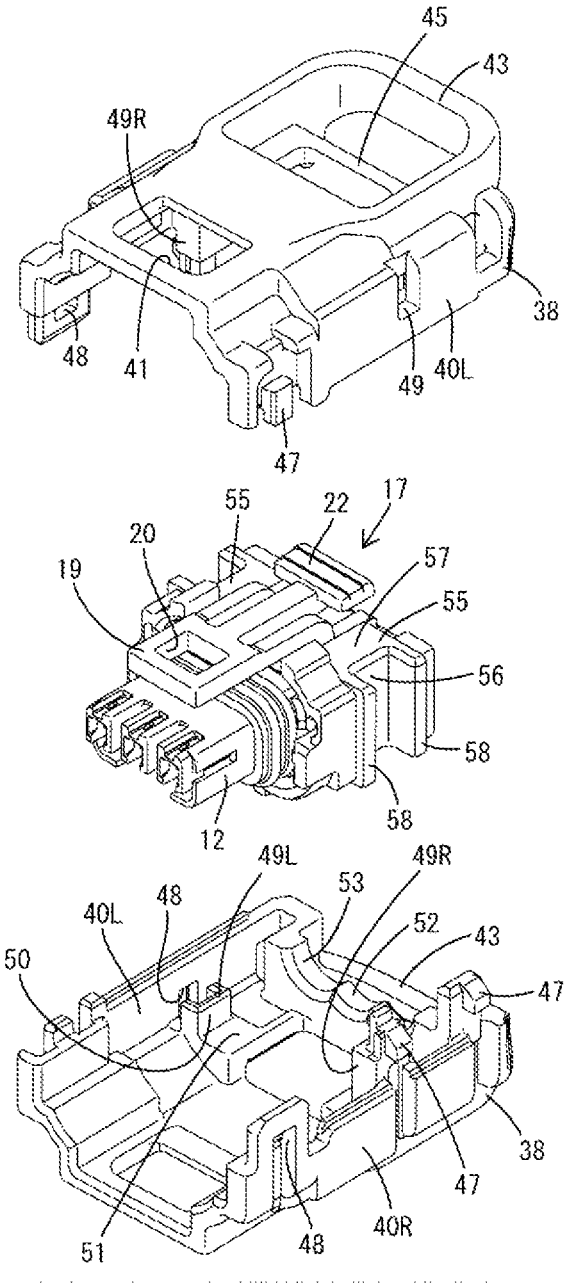
FIG. 2 is a perspective view showing a state where a housing body portion constituting an inner housing and an outer housing are separated.

As shown in FIGS. 2 and 17, the half member 38 is formed with two bilaterally asymmetrical positioning projections 49L, 49R projecting down from both left and right side edge parts of the lower surface (inner surface) of the outer wall 39. The pair of positioning projections 49L, 49R are arranged in a substantially central part (position corresponding to a front of the operation opening 44) of the half member 38 in the front-back direction. The left positioning projection 49L is arranged at the same position as the locking hole 48 in the front-back direction. The right positioning projection 49R is arranged at the same position as the locking projection 47 in the front-back direction. Inner side surfaces of the positioning projections 49L, 49R serve as inner contact surfaces 50 facing laterally inward. Areas of the lower surface of the outer wall 39 connected substantially at a right angle to the inner contact surfaces 50 function as pressing surfaces 51.

As shown in FIGS. 17 and 18, the half member 38 is formed with a pressure receiving portion 52 projecting from the lower surface of the rear edge protecting portion 45. The lower surface of the pressure receiving portion 52 is formed by juxtaposing three concave surfaces 53 corresponding to the three terminal accommodating chambers 13. The pressure receiving portion 52 is arranged at the same position as the locking hole 48 on the rear end part of the left side wall 40L and the locking projection 47 on the rear end part of the right side wall 40R in the front-back direction.

With the half members 38 united, the lower end edges of the upper left and right side walls 40L, 40R and the upper end edges of the lower left and right side walls 40L, 40R butt into contact and the outer housing 37 substantially in the form of a rectangular tube configured by two upper and lower outer walls 39 and two upper and lower pairs of side walls 40L, 40R. The inner housing 11 is to be accommodated into the outer housing 37. Further, the locking projections 47 and the locking holes 48 formed on the upper half member 38 are locked respectively to the locking holes 48 and the locking projections 47 formed on the lower half member 38 at three positions of the outer housing 37 spaced apart in the front-back direction. This locking action holds the half members 38 in a united state.

Further, with the half members 38 united, the positioning projections 49L, 49R of the upper half member 38 and the positioning projections 49L, 49R of the lower half member 38 are vertically connected with the projecting end surfaces thereof butted against each other. Further, one holding hole 54 formed by laterally connecting three circles is formed between the pressure receiving portion 52 of the upper half member 38 and the pressure receiving portion 52 of the lower half member 38.

<Resilient Positioning Members 55>

Figure 14:
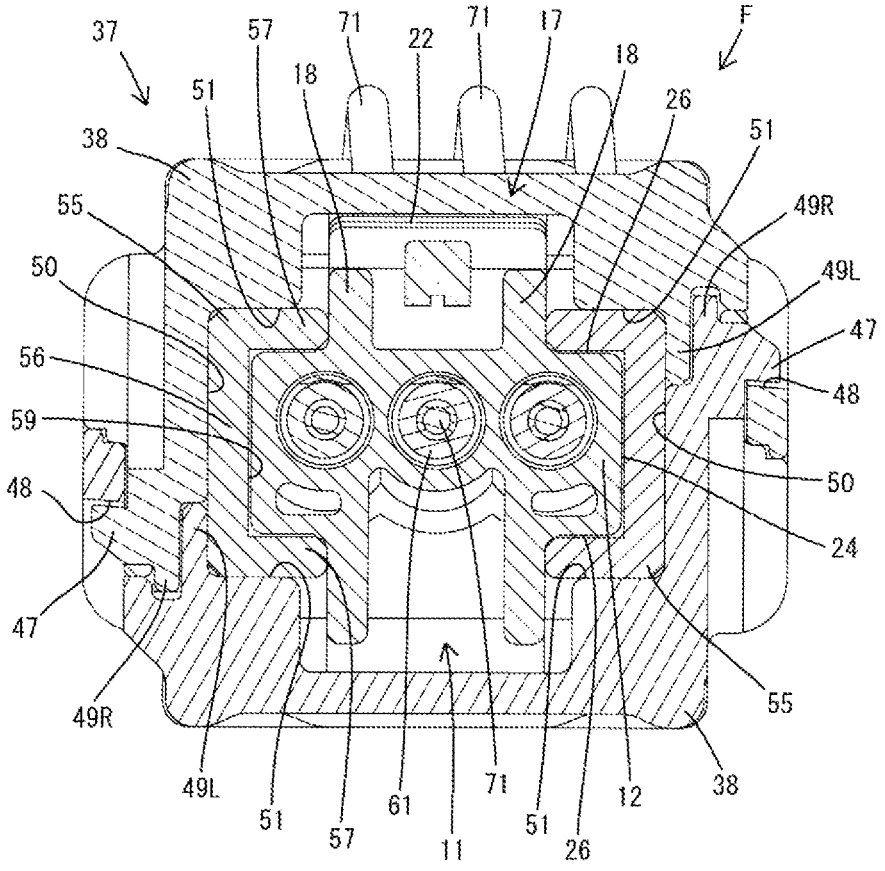
FIG. 14 is a section along D-D of FIG. 9.

As shown in FIGS. 1, 12 and 14, the inner housing 11 and the outer housing 37 described above are mounted via the pair of bilaterally symmetrical resilient positioning members 55. The resilient positioning members 55 are arranged between the inner housing 11 and the outer housing 37 and position the inner housing 11 and the outer housing 37 such that the inner housing 11 and the outer housing 37 are relatively displaceable in three-dimensional directions (vertical, lateral and front-back directions) while being held out of contact.

As shown in FIG. 1, the left and right resilient positioning members 55 are identical components that are bilaterally symmetrical. Further, one resilient positioning member 55 is substantially symmetrical in the vertical direction and the front-back direction. The resilient positioning member 55 includes a base plate 56, upper and lower inward facing ribs 57 and front and rear outward facing ribs 58. The base plate 56 has a substantially square shape with a plate thickness direction substantially aligned with the lateral direction.

The pair of inward facing ribs 57 are in the form of flat plates substantially at a right angle to the base plate 56 and parallel to each other. The inward facing ribs 57 project laterally inwardly (toward the inner housing 11) from both upper and lower edge parts of the base plate 56. The inward facing ribs 57 are formed over the entire area of the base plate 56 in the front-back direction. A space surrounded by the base plate 56 and the pair of inward facing ribs 57 serves as an inward facing recess 59 open laterally inward and both forward and backward.

The pair of outward facing ribs 58 are in the form of flat plates substantially at a right angle to the base plate 56 and substantially parallel to each other. Contrary to the inward facing ribs 57, the outward facing ribs 58 project laterally outwardly (toward the outer housing 37) from both front and rear edges of the base plate 56. The outward facing ribs 58 are formed over the entire area of the base plate 56 in the vertical direction. A space surrounded by the base plate 56 and the outward facing ribs 58 defines an outward facing recess 60 open laterally outward and both upward and downward. The inward facing ribs 57 and the outward facing ribs 58 project from mutually different sides of the outer periphery of the base plate 56.

With the pair of resilient positioning members 55 mounted between the inner housing 11 and the outer housing 37, the inward facing ribs 59 are fit to left and right side surfaces of the inner housing 11, the base plates 56 are fit into the positioning recesses 23 of the inner housing 11 and the outward facing ribs 60 are fit to the positioning projections 49L, 49R of the outer housing 37. The base plates 56 are sandwiched between the outer contact surfaces 24 of the inner housing 11 and the inner contact surfaces 50 of the outer housing 37 in the lateral direction (plate thickness direction of the base plates 56).

The upper inward facing ribs 57 are sandwiched between the upper receiving surfaces 26 of the inner housing 11 and the upper pressing surfaces 51 of the outer housing 37 in the vertical direction (plate thickness direction of the inward facing ribs 57), and the lower inward facing ribs 57 are sandwiched between the lower receiving surfaces 26 of the inner housing 11 and the lower pressing surfaces 51 of the outer housing 37 in the vertical direction. The front outward facing ribs 58 are sandwiched between the front facing surfaces 25 of the inner housing 11 and the front surface of the outer housing 37 in the front-back direction (plate thickness direction of the outward facing ribs 58) and the rear outward facing ribs 58 are sandwiched between the rear facing surfaces 25 of the inner housing 11 and the rear surface of the outer housing 37 in the front-back direction.

With the inner housing 11 and the outer housing 37 assembled, the operation opening 44 of the outer housing 37 is located to correspond to the lock releasing portion 22 of the lock arm 17 in the front-back direction and the lateral direction. An operator can press the lock releasing portion 22 down (lock releasing direction) by inserting a finger into the operation opening 44. Further, the interference avoiding hole 41 of the outer housing 37 is located to correspond to the lock 19 of the lock arm 17 in the front-back direction and the lateral direction. When the lock 19 is displaced resiliently up, a part (front end part) thereof can enter the interference avoiding hole 41.

<Rubber Plugs 61>

Figure 21:
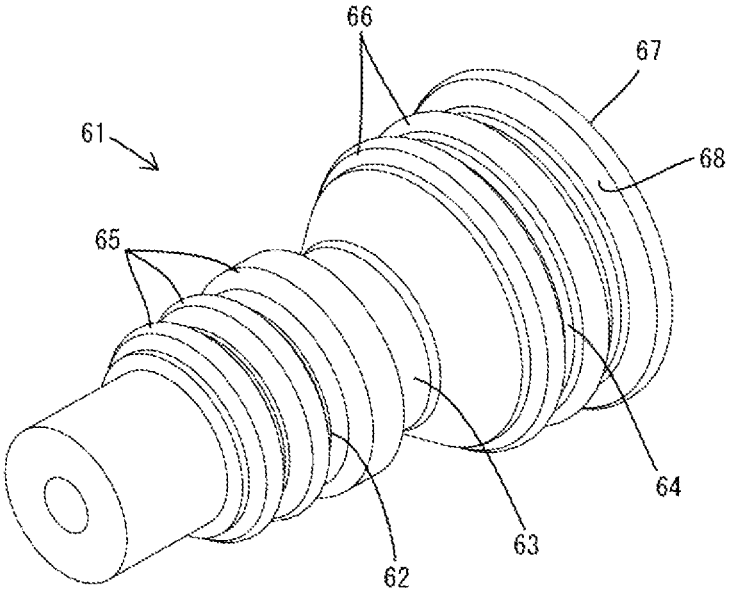
FIG. 21 is a perspective view showing the rubber plug viewed obliquely from front.

As shown in FIGS. 9, 10 and 21, the rubber plug 61 of the conductive path 70 is a hollow cylindrical single component formed by integrating a hollow cylindrical sealing portion 62, a hollow cylindrical thin portion 63 concentrically connected to the rear end of the sealing portion 62 and a hollow cylindrical vibration damping ring 64 concentrically connected to the rear end of the thin portion 63. Rib-like first lips 65 projecting along a circumferential direction are formed side by side at a fixed interval in the front-back direction on the outer periphery of the sealing portion 62. Rib-like inner peripheral seal lips (not shown) project along the circumferential direction and are formed side by side at a fixed interval in the front-back direction on the inner periphery of the sealing portion 62.

Plural rib-like second lips 66 project along the circumferential direction and are formed side by side at a fixed interval in the front-back direction on the outer periphery of the vibration damping ring 64. Plural rib-like inner peripheral lips (not shown) also projecting along the circumferential direction and are formed side by side at a fixed interval in the front-back direction on the inner periphery of the vibration damping ring 64. An inner diameter of the inner peripheral lips is substantially equal to that of the inner peripheral seal lips and smaller than an outer diameter of the wires 71. An outer diameter of the second lips 66 is set larger than that of the first lips 65 of the sealing portion 62.

A substantially concentric and circular large-diameter portion 67 is formed on a rear end part of the outer periphery of the vibration damping ring 64. The large-diameter portion 67 has a larger outer diameter than the second lip portions 66. As shown in FIG. 9, the front surface of an outer periphery of the large-diameter portion 67 defines a front tapered surface 68 inclined with respect to the lateral direction orthogonal to an axis of the rubber plug 61 (vibration damping ring 64). The rear surface of the outer periphery of the large-diameter portion 67 defines a rear tapered surface 69 inclined with respect to the lateral direction orthogonal to the axis of the rubber plug 61 (vibration damping ring 64). These front and rear tapered surfaces 68, 69 gradually reduce a thickness (dimension in an axial direction) of the outer peripheral edge part of the large-diameter portion 67 toward a radially outer side and smallest on the outermost peripheral edge.

An outer diameter of the thin portion 63 is larger than that of the first lips 65 of the sealing portion 62 and an inner diameter thereof is larger than that of the inner peripheral seal lips of the sealing portion 62. That is, the thin portion 63 is formed to be thinner than the sealing portion 62 and the vibration damping ring 64. Thus, the thin portion 63 easily is deformed resiliently as compared to the sealing portion 62 and the vibration damping ring 64.

The rubber plug 61 is fit externally on the front end part of the wire 71 and a front end part thereof is fixed together with the wire 71 to the rear end part of the female terminal fitting 71 e.g. by crimping. The female terminal fitting 72 is inserted into the terminal accommodating chamber 13 from behind is retained by the locking action of the locking lance 14. The sealing portion 62 of the rubber plug 61 is fit individually into a rear end part of the terminal accommodating chamber 13. The first lips 65 are held in close contact with the sealing surface 16 and the inner peripheral seal lips are held in close contact with the outer periphery of the wire 71, thereby preventing the intrusion of fluid such as water into the terminal accommodating chamber 13 e.g. from behind.

The sealing portions 62 of the three rubber plugs 61 are inserted individually into the terminal accommodating chambers 13 and arranged side by side in the lateral direction. Further, the vibration damping rings 64 of the three rubber plugs 61 are fit to penetrate through one holding hole 54 formed by the pressure receiving portions 52 of the outer housing 37. In the holding hole 54, the second lips 66 of adjacent vibration damping rings 64 are held in contact with each other while being resiliently deformed. Upper and lower surface parts of the second lips 66 are held resiliently in contact with the pressure receiving portions 52 and the inner peripheral lips are held resiliently in contact with the wires 71. Although the vibration damping rings 64 are directly in contact with the outer housing 37, they are not in contact with the inner housing 11.

As shown in FIGS. 9 to 12, the large-diameter portions 67 on the rear ends of the vibration damping rings 64 are located behind the holding hole 54. Adjacent large-diameter portions 67 are held partially in close contact with the front tapered surface 68 of one large-diameter portion 67 and the rear tapered surface 69 of the other large-diameter portion 67 resiliently held in contact. Both the front and rear tapered surfaces 68, 69 are oblique to an arrangement direction of the large-diameter portions 67 (vibration damping rings 64). Thus, neither a large step nor unevenness is present on a boundary part between the rear surfaces of the adjacent large-diameter portions 67.

The front end part of the wire 71 inserted into the rubber plug 61 has a displacement relative to the rubber plug 61 in the front-back direction restricted by the resilient close contact of the inner peripheral seal lips and the inner peripheral lips. A part of the wire 71 drawn out backward from the rubber plug 61 is looped and wound around the slack holding portion 43 of the upper half member 38 in a slackened state, as shown in FIG. 9. The wire 71 may be directly in contact with the slack holding portion 43 (outer housing 37) or may not be in contact with the slack holding portion 43.

<Connection and Separation of Male Connector M and Female Connector F>

In connecting the male and female connectors M and F, a front end part of the inner housing 11 is fit into the receptacle 82. In the process of connecting the two connectors M, F, the lock 19 interferes with the lock projection 83 so that the lock arm 17 is displaced resiliently in the lock releasing direction, as shown in FIG. 10. At this time, the lock 19 is displaced up to approach the outer wall 39 of the outer housing 37, but the lock 19 does not interfere with the outer housing 37 since the outer wall 39 is formed with the interference avoiding hole 41.

When the two connectors M, F are properly connected, the lock 19 passes through the lock projection 83 as shown in FIG. 9. Thus, the lock arm 17 is resiliently restored and the lock hole 20 of the lock 19 is locked to the lock projection 83. By this locking action, the two connectors F, M are locked in a connected state and the tabs 85 of the male terminal fittings 84 and the female terminal fittings 72 are brought into contact to be conductive to each other.

In separating the two connectors M, F in the connected state, the lock releasing portion 22 is pressed. By this operation, the lock arm 17 resiliently displaces and the lock 19 separates from the lock projection 83. Thus, the two connectors M, F may be pulled apart with the lock releasing portion 22 kept pressed. At this time, the lock 19 is displaced up to approach the upper outer wall 39, but the lock 19 does not interfere with the outer wall 39 (outer housing 37) because the interference avoiding hole 41 is open above the lock 19.

<Functions and Effects of Slack Holding Portion 43>

The female connector F includes the female housing 10, the female terminal fittings 72 fixed to the front end parts of the wires 71 and inserted into the female housing 10 from behind and the slack holding portion 43 formed on the female housing 10 and configured to hold the wires 71 drawn out backward from the female housing 10 in a slackened state. If the wire 71 vibrates behind the female housing 10, the wire 71 held in a slackened state by the slack holding portion 43 resiliently deforms to change a curvature thereof near the female housing 10. Since vibration energy of the wire 71 is attenuated by the wire 71 itself being resiliently deformed in this way, the female connector F is excellent in the function of suppressing the transfer of vibration from the wire 71 to the female terminal fitting 72. Further, since the wires 71 are looped and wound around the slack holding portion 43, the wires 71 are not detached from the slack holding portion 43.

The female housing 10 includes the inner housing 11 for accommodating the female terminal fittings 72 and the outer housing 37 relatively displaceable with respect to the inner housing 11. The slack holding portion 43 is formed on the outer housing 37 and the wires 71 can come into contact with the slack holding portion 43 (outer housing 37) when vibrating. According to this configuration, when the wire 71 collides with the slack holding portion 43 (outer housing 37) in attenuating vibration while being resiliently deformed, the vibration of the wire 71 is transferred to the outer housing 37, but is not directly transferred to the inner housing 11. Thus, the vibration of the wire 71 is difficult to transfer to the female terminal fitting 72 in the inner housing 11.

<Functions and Effects of Rubber Plugs 61 and Vibration Damping Rings 64>

The female connector F has the female housing 10 and the female terminal fittings 72 individually fixed to the front end parts of the wires 71, and the female housing 10 is formed with the terminal accommodating chambers 13 into which the terminal fittings are inserted individually. The rubber plugs 61 are fit externally on the respective wires 71 behind and near the female terminal fittings 72 for sealing a clearance between the outer periphery of the wires 71 and the inner periphery of the terminal accommodating chambers 13 (inner housing 11) individually. The vibration damping rings 64 are formed on the rear end parts of the rubber plugs 61 and two adjacent vibration damping rings 64 are held resiliently in contact with each other.

Vibration energy of the wire 71 is attenuated by the rubber plug 61 when the wire 71 vibrates outside the female housing 10. The vibration damping rings 64 of adjacent rubber plugs 61 are held resiliently in contact with each other. Thus, the vibration energy also is attenuated between adjacent rubber plugs 61 to provide excellent vibration attenuation of the wires 71 by the rubber plugs 61.

The female connector F includes the inner housing 11. The female terminal fittings 72 fixed to the front end parts of the wires 71 are inserted into the inner housing 11 from behind. The outer housing 37 is held out of contact with the female terminal fittings 72 and mounted relatively displaceably with respect to the inner housing 11. The vibration damping ring 64 is fit externally on the wire 71 in a state out of contact with the inner housing 11, and resiliently held in contact with the outer housing 37.

Vibration energy of the wire 71 that vibrates outside the female housing 10, is transferred to the outer housing 37 via the vibration damping ring 64 and is attenuated by an inertial force of the outer housing 37. In this way, the transfer of vibration from the wire 71 to the female terminal fitting 72 is suppressed. There is no direct contact between the vibration damping ring 64 and the inner housing 11 and hence no vibration transfer path is present between the vibration damping ring 64 and the female terminal fitting 72. Thus, the function of suppressing the transfer of vibration from the wire 71 to the female terminal fitting 72 is excellent.

The large-diameter portion 67 is formed on the rear end of the vibration damping ring 64 and the front and rear tapered surfaces 68, 69 inclined with respect to the arrangement direction of adjacent rubber plugs 61 are formed on front and rear surfaces of the outer periphery of the large-diameter portion 67. The front tapered surface 68 and the rear tapered surface 69 of adjacent rubber plugs 61 are held in contact. Accordingly, steps and unevenness are small at and near a boundary between the rear surfaces of the adjacent vibration damping rings 64. Thus, even if high-pressure washing water is sprayed from behind the female housing 10, that washing water is difficult to intrude into a clearance between adjacent large-diameter portions 67 (vibration damping rings 64).

Further, the rubber plug 61 includes the sealing portion 62 to be held in close contact with the inner periphery of the inner housing 11 in a liquid-tight manner and the outer diameter of the vibration damping ring 64 is larger than that of the sealing portion 62. According to this configuration, since the vibration damping ring 64 having a large outer diameter is present behind the sealing portion 62, even if high-pressure washing water is sprayed from behind the outer housing 37, the high-pressure washing water is not directly sprayed to the sealing portion 62. Further, since the vibration damping ring 64 is formed integrally or unitarily to the rubber plug 61, the number of components is reduced as compared to the case where the vibration damping ring 64 is a component separate from the rubber plug 61.

<Functions and Effects of Resilient Positioning Members 55>

The female connector F includes the female housing 10. The female terminal fittings 72 fixed to the front end parts of the wires 71 are inserted into the female housing 10 from behind. The outer housing 37 is held out of contact with the female terminal fittings 72 and mounted relatively displaceably with respect to the inner housing 11. Further, the female connector F includes the resilient positioning members 55 configured to position the inner housing 11 and the outer housing 37 and spaced apart in the circumferential direction. That is, the inner housing 11 and the outer housing 37 constituting the female connector F are mounted while being positioned via the resilient positioning members 55.

According to this configuration, vibration energy transferred from the wire 71 to the outer housing 37 is attenuated by the resilient positioning members 55. Thus, the transfer of vibration to the inner housing 11 is suppressed. Further, since a means for positioning the inner housing 11 and the outer housing 37 is not a ring-shaped member continuous over the entire circumference, but the pair of resilient positioning members 55 spaced apart in the circumferential direction, material cost can be suppressed low.

Further, the two resilient positioning members 55 are arranged to sandwich the inner housing 11 from both left and right sides and each include the base plate 56, the inward facing ribs 57 and the outward facing ribs 58. The base plate 56 is held in contact with the outer side surface (outer contact surface 24) of the inner housing 11 and the inner side surface (inner contact surface 50) of the outer housing 37. The inward facing ribs 57 project inward of the base plate 56 from the base plate 56 and are vertically sandwiched between the inner housing 11 and the outer housing 37. The outward facing ribs 58 project outwardly of the base plate 56 from the base plate 56 and are sandwiched between the inner housing 11 and the outer housing 37 in the front-back direction.

According to this configuration, the inward facing ribs 57 and the outward facing ribs 58 are resiliently deformed when the inner housing 11 and the outer housing 37 are relatively displaced. The inward facing ribs 57 and the outward facing ribs 58 project from the base plate 56 toward sides opposite to each other. Thus, the inward facing ribs 57 are not restricted or affected by the outward facing ribs 58 and outward facing ribs 58 also are not restricted or affected by the inward facing ribs 57. Since both the inward facing ribs 57 and the outward facing ribs 58 can be deformed flexibly and resiliently, the resilient positioning members 55 are excellent in performance for suppressing the vibration of the wires 71.

Further, the base plate 56 has a substantially square shape, the inward facing ribs 57 project from two parallel sides (both upper and lower edges) of the four sides of the outer periphery of the base plate 56 and the outward facing ribs 58 project from two parallel sides (both front and rear edges) of the four sides of the outer periphery of the base plate 56. According to this configuration, the inward facing ribs 57 and the outward facing ribs 58 project from different sides of the outer periphery of the base plate 56. Thus, both the inward facing ribs 57 and the outward facing ribs 58 can be flexibly resiliently deformed without being restricted or affected by each other.

<Functions and Effects of Lock Arm 17>

The female housing 10 has the inner housing 11 for accommodating the female terminal fittings 72. The outer housing 37 is separate from the inner housing 11 and surrounds the inner housing 11. The lock arm 17 is formed on the outer surface of the inner housing 11 and is configured to lock the inner housing 11 and the male housing 80 (mating housing) in the connected state by being locked to the male housing 80. On the other hand, the outer housing 37 is formed with the rear edge protecting portion 45 and the side edge protecting portions 46 arranged near the lock releasing portion 22 of the lock arm 17.

According to this configuration, the rear edge protecting portion 45 and the side edge protecting portions 46 arranged near the lock releasing portion 22 of the lock arm 17 restrict the interference of external matter with the lock releasing portion 22. This can prevent the lock releasing portion 22 from being inadvertently unlocked due to the interference of external matter. Further, the rear edge protecting portion 45 and the side edge protecting portions 46 are formed on the outer housing 37 provided separately from the inner housing 11 formed with the lock arm 17. Thus, as compared to the case where the lock arm 17, the rear edge protecting portion 45 and the side edge protecting portions 46 are formed on one housing, both the inner housing 11 and the outer housing 37 can be simplified.

Further, the lock arm 17 is formed with the lock 19 for holding the inner housing 11 and the male housing 80 in the locked state by being locked to the lock projection 83 of the male housing 80. The lock 19 is displaced in a direction away from the outer surface of the inner housing 11 due to interference with the lock projection 83 in the process of connecting the two connectors M, F. On the other hand, the outer housing 37 is formed with the interference avoiding hole 41 for avoiding interference with the lock 19.

According to this configuration, the interference avoiding hole 41 is open on the outer housing 37 to avoid interference of the lock 19 and the outer housing 37. Thus, the outer housing 37 can be miniaturized as compared to the case where the outer housing 37 is kept away from the outer surface of the inner housing 11 to avoid interference with the lock 19.

<Functions and Effects of Male and Female Housings 80, 10>

The inner housing 11 constituting the female connector is connectable to the male housing 80 (mating housing) including the male terminal fittings 84 (mating terminals). The inner housing 11 is formed with the lock arm 17 for holding the connected state to the male housing 80 by being locked to the male housing 80. According to this configuration, since the inner housing 11 accommodating the female terminal fittings 72 and the male housing 80 can be locked in the connected state by the lock arm 17, fine sliding abrasion in the front-back direction between the female terminal fittings 72 and the male terminal fittings 84 can be suppressed.

The inner housing 11 may be formed with the displacement restricting portions 36 for restricting relative displacements in the vertical direction and the lateral direction with respect to the male housing 80. According to this configuration, the inner housing 11 is connected with relative displacements with respect to the male housing 80 restricted, and relative displacements of the female terminal fittings 72 and the male terminal fittings 84 are restricted. In this way, fine sliding abrasion between the female terminal fittings 72 and the male terminal fittings 84 can be suppressed.

Further, the inner housing 11 includes the housing body 12 for accommodating the female terminal fittings 72. The front retainer 30 is mounted in the front end part of the housing body 12 and is configured to restrict the escape of the female terminal fittings 72 from the housing body 12. The displacement restricting portions 36 project on the outer peripheral surface of the front retainer 30 and are held in close contact with the inner periphery of the receptacle 82 of the male housing 80 while being plastically deformed. The displacement restricting portions 36 restrict relative displacements between the inner housing 11 and the male housing 80 and thus restrict relative displacements between the female terminal fittings 72 and the male terminal fittings 84. In this way, fine sliding abrasion between the female terminal fittings 72 and the male terminal fittings 84 can be suppressed. The displacement restricting portions 36 are not formed on the housing body 12, but on the front retainer 30. Thus, the shape of the housing body 12 can be simplified.

The front wall 31 of the front retainer 30 is formed with the restricting projections 33 for restricting forward movements of the female terminal fittings 72 by coming into contact with the front surfaces of the female terminal fittings 72. The female terminal fittings 72 are pressed back against the locking lances 14 by the restricting projections 33 and are sandwiched in the front-back direction between the restricting projections 33 and the locking lances 14 so that movements of the female terminal fittings 72 in the front-back direction are restricted. According to this configuration, forward movements of the female terminal fittings 72 can be reliably restricted, utilizing the front retainer 30 separate from the housing body 12. In this way, fine sliding abrasion between the female terminal fittings 72 and the male terminal fittings 84 can be prevented.

OTHER EMBODIMENTS

The invention is not limited to the above described embodiment. For example, the following embodiments also are included in the scope of the invention.

The vibration damping ring is integral to the rubber plug in the above embodiment. However, the vibration damping ring may be a component separate from the rubber plug.

The vibration damping ring is behind the sealing portion in the above embodiment. However, the vibration damping ring may be a component separate from the rubber plug and arranged in front of the rubber plug (sealing portion) or the vibration damping ring and the rubber plug may be arranged substantially at the same position in the front-back direction.

The vibration damping ring has a larger outer diameter than the sealing portion in the above embodiment. However, the outer diameter of the vibration damping ring may be equal to that of the sealing portion.

The inner housing and the mating housing are connected with relative displacements restricted in the above embodiment. However, the inner housing and the mating housing may be slightly relatively displaceable in the connected state.

The inner housing is formed by mounting the front retainer in the housing body in the above embodiment, but the inner housing may be a single component.

Forward movements of the terminal fittings are restricted by the front wall of the front retainer in the above embodiment. However, the front wall may be configured not to restrict forward movements of the terminal fittings.

The lock arm is the means for holding the connected state to the mating housing and is formed on the inner housing in the above embodiment. However, the lock arm may be formed on the outer housing.

The inner housing and the outer housing are mounted via the resilient positioning members in the above embodiment, but the resilient positioning member may be a ring-shaped single component.

The resilient positioning members are bilaterally symmetrical in the above embodiment, but they may be bilaterally asymmetrical.

The resilient positioning member has the inward facing ribs and the outward facing ribs projecting from the base plate in the above embodiment. However, the resilient positioning member may be such that only the inward facing ribs or outward facing ribs project from the base plate and these ribs are sandwiched in the vertical direction and the front-back direction between the inner housing and the outer housing.

The inward facing ribs and the outward facing ribs project from different sides of the outer periphery of the base plate in the above embodiment, but the inward facing ribs and the outward facing ribs may project from the same sides.

Two inward facing ribs are formed in the above embodiment, but one, three or more inward facing ribs may be provided.

Two outward facing ribs are formed in the above embodiment, but one, three or more outward facing ribs may be provided.

The wires are looped and wound around the slack holding portion in the above embodiment, but the wires may be placed on and hooked to the slack holding portion without being wound around the slack holding portion.

The waterproof rubber plugs are provided in the above embodiment, but the invention can be applied to non-waterproof connectors with no rubber plug.

Three female terminal fittings are accommodated in the inner housing in the above embodiment, but two, four or more female terminal fittings may be accommodated.

The housing includes the inner housing and the outer housing in the above embodiment, but the housing may be composed of a single component.

The interference avoiding hole is open on the outer surface of the outer housing in the above embodiment. However, the interference avoiding hole may be formed by recessing an inner surface of the outer housing without being open on the outer surface of the outer housing.

The outer housing is formed with the interference avoiding hole as a means for avoiding interference with the lock in the above embodiment. However, interference with the lock may be avoided by enlarging the outer housing without forming the interference avoiding hole.

The inner housing and the outer housing are relatively displaceable in the above embodiment, but the inner housing and the outer housing may be fixedly assembled not to be relatively displaced.

Tapered surfaces are formed on both front and rear of the vibration damping ring in the above embodiment. However, the vibration damping ring may be formed with no tapered surface.

Although the vibration damping ring is resiliently held in contact with the outer housing in the above embodiment, the vibration damping ring may not be out of contact with the outer housing.

REFERENCE SIGNS

F . . . female connector
10 . . . female housing
11 . . . inner housing
12 . . . housing body
13 . . . terminal accommodating chamber
14 . . . locking lance
17 . . . lock arm
19 . . . lock portion
22 . . . lock releasing portion
30 . . . front retainer
31 . . . front wall
33 . . . restricting projection
36 . . . displacement restricting portion
37 . . . outer housing
38 . . . half member
41 . . . interference avoiding hole
43 . . . slack holding portion
45 . . . rear edge protecting portion
46 . . . side edge protecting portion
55 . . . resilient positioning member
56 . . . base plate
57 . . . inward facing rib
58 . . . outward facing rib
61 . . . rubber plug
62 . . . sealing portion
64 . . . vibration damping ring
68 . . . front tapered surface
69 . . . rear tapered surface
71 . . . wire
72 . . . female terminal fitting
80 . . . male housing
82 . . . receptacle
83 . . . lock projection
84 . . . male terminal fitting

What is claimed is:

1. A connector, comprising:

an inner housing;

at least one terminal fitting fixed to at least one wire and inserted into the inner housing;

an outer housing formed separately from the inner housing and held out of contact with the terminal fitting, the outer housing being mounted relatively displaceably with respect to the inner housing; and a resilient member fit externally on the wire and configured to seal a clearance between the wire and the inner housing, at least one vibration damping ring externally fit on the wire in a state out of contact with the inner housing, and resiliently held in contact with the outer housing, the vibration damping ring being formed integrally or unitarily to the resilient member.

2. The connector of claim 1, wherein the inner housing and the outer housing are positioned via at least one resilient positioning member.

3. The connector of claim 1, wherein:

the inner housing is connectable to a mating housing including at least one mating terminal; and the inner housing is formed with at least one displacement restricting portion configured to restrict a relative displacement with respect to the mating housing.

4. The connector of claim 3, wherein:

the inner housing includes a housing body configured to accommodate the terminal fitting and a front retainer mounted to a front end part of the housing body and configured to restrict an escape of the terminal fitting from the housing body; and the displacement restricting portion projects on an outer peripheral surface of the front retainer and is capable of being held in close contact with an inner periphery of a receptacle of the mating housing while being deformed plastically.

5. The connector of claim 4, further comprising:

at least one locking lance configured to retain the terminal fitting inserted into the inner housing from behind; and a restricting projection formed on a front wall of the front retainer and configured to restrict a movement of the terminal fitting by contacting the terminal fitting and sandwiching the terminal fitting between the locking lance and the restricting projection substantially in a front-back direction.

6. The connector of claim 1, wherein:

the inner housing is connectable to a mating housing including at least one mating terminal; and the inner housing has a lock arm configured to hold a connected state to the mating housing by being locked to the mating housing.

7. The connector of claim 1, wherein:

the resilient member includes at least one sealing portion to be held in close contact with an inner periphery of the inner housing in a fluid-tight manner; and the vibration damping ring is arranged behind the sealing portion and has a larger outer diameter than the sealing portion.

8. The connector of claim 7, wherein the resilient member further includes a tubular thin portion extending between the sealing portion and the vibration damping ring, the tubular thin portion having a radial thickness less than radial thicknesses of the sealing portion and the vibration damping ring to facilitate deflection of the resilient member in response to relative displacement between the inner housing and the outer housing.

9. The connector of claim 8, wherein the tubular thin portion extends between the inner housing and the outer housing.

10. The connector of claim 7, further comprising a large-diameter portion on a rear end of the vibration damping ring and defining an outer diameter larger than an outer diameter of the vibration damping ring.

11. A connector, comprising:

an inner housing having terminal accommodating chambers with inner sealing surfaces;

terminal fittings fixed respectively to wires and inserted respectively into the terminal accommodating chambers of the inner housing;

an outer housing formed separately from the inner housing and held out of contact with the terminal fitting, the outer housing being mounted relatively displaceably with respect to the inner housing; and resilient members formed respectively with sealing portions fit respectively on parts of the terminal fittings that are fixed to the wires and on parts of the wires adjacent the terminal fittings, the sealing portions being sealingly engaged respectively with the sealing surfaces of the terminal accommodating chambers of the inner housing, each of the resilient members further a vibration damping ring externally fit on the respective wire in a state out of contact with the inner housing, and resiliently held in contact with the outer housing.

12. The connector of claim 11, wherein each of the resilient members further includes a tubular thin portion extending between the sealing portion and the vibration damping ring of the respective resilient member, the tubular thin portions having a radial thicknesses less than radial thicknesses of the sealing portions and the vibration damping rings to facilitate deflection of the resilient members in response to relative displacement between the inner housing and the outer housing.

13. The connector of claim 12, wherein the tubular thin portion extends between the inner housing and the outer housing.

14. The connector of claim 11, wherein each of the resilient members further comprises a large-diameter portion on a rear end of the vibration damping ring and defining an outer diameter larger than an outer diameter of the vibration damping ring.

15. The connector of claim 14, wherein the large-diameter portion of each of the resilient members contacts the large-diameter portion of the at least one other of the resilient members.

* * * * *